US009238527B2

(12) United States Patent
Kakuta et al.

(10) Patent No.: US 9,238,527 B2
(45) Date of Patent: Jan. 19, 2016

(54) DISPENSING CONTAINER

(75) Inventors: Yoshiyuki Kakuta, Tokyo (JP); Satoshi Sakamoto, Tokyo (JP); Keisuke Miyairi, Tokyo (JP); Denmi Kuwagaki, Noda (JP); Masashi Fukumoto, Noda (JP)

(73) Assignees: YOSHINO KOGYOSHO CO., LTD., Tokyo (JP); KIKKOMAN CORPORATION, Chiba (JP)

( * ) Notice: Subject to any disclaimer, the term of this patent is extended or adjusted under 35 U.S.C. 154(b) by 79 days.

(21) Appl. No.: 14/124,012

(22) PCT Filed: Jun. 5, 2012

(86) PCT No.: PCT/JP2012/064444
§ 371 (c)(1),
(2), (4) Date: Jan. 31, 2014

(87) PCT Pub. No.: WO2012/169489
PCT Pub. Date: Dec. 13, 2012

(65) Prior Publication Data

US 2014/0144938 A1 May 29, 2014

(30) Foreign Application Priority Data

Jun. 9, 2011 (JP) ..... 2011-128826
Jul. 11, 2011 (JP) ..... 2011-153262
Aug. 9, 2011 (JP) ..... 2011-173843

(51) Int. Cl.
*B65D 35/56* (2006.01)
*B65D 35/14* (2006.01)
(Continued)

(52) U.S. Cl.
CPC ..... *B65D 35/14* (2013.01); *B65D 1/0215* (2013.01); *B65D 23/02* (2013.01); *B65D 47/0838* (2013.01); *B65D 47/0842* (2013.01); *B65D 47/2075* (2013.01); *B65D 47/2093* (2013.01); *B65D 47/32* (2013.01); *B65D 83/0055* (2013.01)

(58) Field of Classification Search
CPC ..... B65D 35/14; B65D 47/0838; B65D 47/0842; B65D 47/2031; B65D 47/2075; B65D 47/2093; B65D 47/32; B65D 51/16; B65D 51/1644; B65D 51/1655; B65D 77/06; B65D 77/065; B65D 77/067; B65D 77/068; B65D 83/0055; B65D 83/0061
USPC ..... 222/105, 106, 107, 110, 111, 183, 212, 222/213, 215, 380, 387, 422, 544–563
See application file for complete search history.

(56) References Cited

U.S. PATENT DOCUMENTS 5,190,190 A * 3/1993 Fudalla ..... 222/105
5,454,486 A * 10/1995 Mack et al. ..... 222/95
(Continued)

FOREIGN PATENT DOCUMENTS

JP 7-28055 U 5/1995
JP 10045180 * 2/1998 ..... B65D 83/00
(Continued)

*Primary Examiner* — Frederick C Nicolas
*Assistant Examiner* — Bob Zadeh
(74) *Attorney, Agent, or Firm* — Mattingly & Malur, PC

(57) ABSTRACT

A dispensing container provides that after discharging content, the content which has not been returned to an internal container is prevented from leaking out of a discharge port. The dispensing container has an internal container which contains content and an external container in which the internal container is attached. The external container is provided with a suction port for sucking external air in between the internal container and the external container. A discharge cap is attached to a spout and is provided with a discharge port for discharging the content. The discharge cap includes an inside plug which closes the spout and a cylindrical body covering the inside plug and being provided with the discharge port. The inside plug is provided with a communication port. A valve that is slidable along an axial direction of the communication port is provided to open and close the communication port.

9 Claims, 19 Drawing Sheets

(51) Int. Cl.

| | |
|---|---|
| ***B65D 23/02*** | (2006.01) |
| ***B65D 1/02*** | (2006.01) |
| ***B65D 83/00*** | (2006.01) |
| ***B65D 47/08*** | (2006.01) |
| ***B65D 47/20*** | (2006.01) |
| ***B65D 47/32*** | (2006.01) |

(56) References Cited

U.S. PATENT DOCUMENTS

| | | | | |
|---|---|---|---|---|
| 6,286,725 | B1 | 9/2001 | Gerber | |
| 6,672,479 | B2 * | 1/2004 | Shiraishi et al. | 222/105 |
| 2002/0130139 | A1 | 9/2002 | Shiraishi et al. | |
| 2003/0230596 | A1 | 12/2003 | Masuda | |
| 2004/0011810 | A1 * | 1/2004 | Mita et al. | 222/105 |
| 2008/0041890 | A1 | 2/2008 | Masuda | |

FOREIGN PATENT DOCUMENTS

| | | | |
|---|---|---|---|
| JP | 2000-041727 | A | 2/2000 |
| JP | 2002-510372 | A | 4/2002 |
| JP | 2002-263166 | A | 9/2002 |
| JP | 2003-72864 | A | 3/2003 |
| JP | 2003-321048 | A | 11/2003 |
| JP | 2004-231280 | A | 8/2004 |

* cited by examiner

DISPENSING CONTAINER

TECHNICAL FIELD

The present invention relates to a dispensing container. More specifically, the present invention relates to improvements in a cap structure in a dispensing container having a delamination structure.

BACKGROUND ART

In terms of dispensing containers configured to discharge liquid content primarily by pressing the container, a delaminating container having an internal container (inner layer) containing liquid content and an external container (outer layer) on the inner side of which the internal container is layered has been being used in the related art. As an example of such container, a dispensing container as disclosed in Patent Document 1 below is known. This dispensing container includes: a container body having a flexible internal container which contains content and deforms so as to deflate with a decreasing amount of the content and an external container in which the internal container is attached, the external container being provided with a suction port for sucking the external air in between the internal container and the external container; a discharge cap which is attached to a spout of the container body and provided with a discharge port for discharging the content; an external-air inlet port which communicates between the outside and the suction port; and an air valve which switches between the communicated state and shutoff state of the communication between the external-air inlet port and the suction port. The discharge cap includes a cylindrical body member having a top-closed cylindrical shape, an outlet pipe which communicates with the inside of the cylindrical body member, and a check valve which switches between the communicated state and the shutoff state of the communication between the cylindrical body member and the outlet pipe.

RELATED ART REFERENCES

Patent Document

Patent Document 1: Japanese laid-open publication No. 2004-231280

SUMMARY OF THE INVENTION

Problem to be Solved by the Invention

However, in the related-art dispensing container, since the check valve operates after the content in the container has been discharged, the content which has not been returned to the internal container and remains in the outlet pipe might leak out of the discharge port.

The present invention has been made in view of the above circumference and an object of the present invention is to provide a dispensing container capable of preventing, after the discharge of the content, the content which has not been returned to the internal container from leaking out of the discharge port.

SUMMARY

The present invention proposes the following means in order to solve the above problems.

A dispensing container according to the present invention comprises a dispensing container comprising: a container body having a flexible internal container which contains content and deforms so as to deflate with a decreasing amount of the content and an external container in which the internal container is attached, the external container being provided with a suction port for sucking external air in between the internal container and the external container; a discharge cap which is attached to a spout of the container body and provided with a discharge port for discharging the content; an external-air inlet port which communicates between outside and the suction port; and an air valve which switches between a communicated state and a shutoff state of communication between the external-air inlet port and the suction port, wherein: the discharge cap includes: an inside plug member which closes the spout; and a cylindrical body member having a top-closed cylindrical shape, the cylindrical body member covering the inside plug member and being provided with the discharge port; the inside plug member is provided with a communication port which communicates between the discharge port and the internal container; and a valve body is arranged and fitted in the communication port so as to be slidable along an axial direction of the communication port, the valve body being elastically displaced along the axial direction so as to open and close the communication port.

According to the present invention, when the content is discharged from the dispensing container, the dispensing container is tilted in a discharge posture so that the discharge port is directed downward and the dispensing container is then pressed radially inward to cause the pressure inside the internal container to increase and to thereby cause the content in the internal container to press the valve body. As a result, the valve body is elastically displaced toward the outside of the internal container along the axial direction to open the communication port. Consequently, the content in the internal container is discharged to the outside through the communication port and the discharge port.

Then, by stopping or releasing the pressing against the dispensing container while restoring the dispensing container to the original vertical posture to thereby weaken the pressing force of the content in the internal container against the valve body, the valve body is displaced so as to be restored toward the inner side of the internal container along the axial direction.

At this time, when the valve body enters the communication port, the valve body comes into contact with and slides along the inner peripheral surface of the communication port and thereby closes the communication port. As a result, an internal space in which the content which has not been returned to the internal container remains, is formed between the cylindrical body member and the inside plug member. The internal space communicates with the discharge port and has the valve body as a part of its delimiting walls. The valve body shuts off the communication between the internal space and the communication port.

When, after the internal space is formed as described above, the valve body continues the restoration displacement and slides in the communication port along the axial direction, the internal volume of the internal space increases as the restoration displacement of the valve body proceeds. Accordingly, it becomes possible to introduce the content in the discharge port into the internal space and to suck the external air into the discharge port.

As described above, the dispensing container can allow, after the discharge of the content, the content in the discharge port to be introduced into the internal space and allow the external air to be sucked into the discharge port. Thus, it becomes possible to prevent the content which has not been returned to the internal container from remaining in the discharge port. Consequently, the content can be prevented from leaking out of the discharge port after the discharge of the content.

The inside plug member may include: a plug body having an outer circumferential end arranged on an opening end of the spout, the plug body having a through hole which extends therethrough and opens to the inside of the internal container; and a cylindrical communicating part which is provided upright on the plug body and inside of which the through hole opens, the inside of the cylindrical communicating part defining the communication port, wherein the through hole may have a diameter smaller than that of the communication port.

In this configuration, since the through hole has a smaller diameter than that of the communication port, even if the valve body is unintentionally displaced toward the inner side of the internal container along the axial direction, the valve body will abut onto the portion located on the radially inner side of the plug body with respect to the cylindrical communicating part, and such unintentional displacement of the valve body will able to be restricted.

If the valve body abuts onto the plug body when the dispensing container is not being operated, the communication between the communication port and the through hole can be shut off by the valve body.

In this case, when the valve body is displaced so as to be restored after the content is discharged and the internal space is formed as described above, the valve body can be slid in the communication port over its entire length along the axial direction. This can ensure that the internal volume of the internal space increases and the aforementioned effects and advantages can be significantly exerted.

Note that the sliding (contact and sliding) referred to in the invention of the present application may encompass a state in which there is a small gap between the valve body and the communication port, as long as the aforementioned effects and advantages can still be exerted.

The valve body may be connected via elastically deformable elastic connecting pieces to a cylindrical member which is arranged coaxially with the cylindrical communicating part. The elastic connecting pieces are elastically deformed so as to allow the valve body to be displaced along the axial direction.

In this configuration, the plurality of elastic connecting pieces is preferably arranged at regular intervals circumferentially about the axial direction. In such dispensing container, it is possible to allow the valve body to be displaced along the axial direction while keeping the valve body in a position so as not to be tilted (misaligned) with respect to the axial direction.

In the dispensing container, the plurality of elastic connecting pieces are preferably each curved circumferentially. In such dispensing container, the elastic connecting pieces may be simply housed between the valve body and the cylindrical member arranged coaxially with the cylindrical communicating part. In addition, the elastic connecting piece itself is twisted when the valve body is displaced along the axial direction, and the elasticity of the elastic connecting pieces acts as a force for causing the valve body to be displaced so as to be restored to the original position before the displacement.

The cylindrical body member is preferably provided with a displacement amount restrictor which abuts onto the valve body slidable along the axial direction so as to restrict an amount of elastic displacement of the valve body. The displacement amount restrictor can set the uppermost position (displacement limit position) so that the discharge port is not closed.

The dispensing container may include an over-cap removably attached to the discharge cap, wherein the over-cap is provided with a seal part which is removably fitted into the discharge port.

In this configuration, since the seal part is provided in the over-cap, the content can be prevented from unintentionally leaking out of the discharge port with the over-cap being closed.

After the discharge of the content, the content which has not been returned to the internal container hardly remains in the discharge port as described above. Thus, when the over-cap is attached onto the discharge cap after the discharge of the content and the seal part is fitted into the discharge port, the content can be prevented from being pressed out of the discharge port by the seal part and the content can be prevented from adhering to the seal part.

The seal part in such dispensing container preferably functions as a suppressor which suppresses the elastic displacement of the valve body in a covered state with the over-cap being closed. In this configuration, the displacement of the valve body in the covered state can be suppressed. Thus, even if the container body is pressed by an unexpected external force during distribution or storage, the communication port can be kept closed.

In the dispensing container having the over-cap provided with the seal part, a flow-allowing groove which allows the content to flow therethrough is preferably formed in a part of a portion of a valve seat of the valve body, the portion being in contact with the valve body. This flow-allowing groove can allow the content remaining in the internal space to be returned to the internal container even in a closed state where the valve seat is being seated on the valve seat. The dimension of the flow-allowing groove may be set in accordance with the type of the content. The dimension is set such that the content is finally retained in the flow-allowing groove by its surface tension and the air passage through this groove is blocked. Thus, the amount of the content remaining in the internal space can be reduced and even when the over-cap is closed to provide the covered state and the seal part enters the discharge port to be fitted thereinto, it is possible to prevent the content from being pressed out by the seal part due to the volume of the seal part. Accordingly, it is possible to prevent the content from overflowing and contaminating the inner side of the over-cap and the surface of the discharge cap when the over-cap is closed to provide the covered state.

An auxiliary cylindrical part which communicates with the discharge port may be provided on a circumferential edge of the opening of the discharge port in the cylindrical body member so as to protrude toward the communication port.

In this configuration, since the auxiliary cylindrical part which communicates with the discharge port is provided on the circumferential edge of the opening of the discharge port in the cylindrical body member so as to protrude toward the communication port, when the external air is sucked into the discharge port after the discharge of the content and the air is introduced through the discharge port further toward the communication port, the air will be introduced into the auxiliary cylindrical part. The air introduced into the auxiliary cylindrical part will be introduced more deeply toward the communication port along the axial direction of the discharge port, so that the air will become hardly dispersible in the radial direction of the discharge port.

Accordingly, by introducing the air not only into the discharge port but also further into the auxiliary cylindrical part and preventing, after the discharge of the content, the content M which has not been returned to the internal container from remaining in the discharge port and in the auxiliary cylindrical part, it becomes possible to efficiently prevent the content from leaking out of the discharge port.

In a configuration in which the dispensing container includes the over-cap removably attached to the discharge cap and in which the over-cap is provided with a seal part to be removably fitted into the discharge port, by preventing, after the discharge of the content, the content which has not been returned to the internal content from remaining in the discharge port and in the auxiliary cylindrical part as described above, even if the seal part extends not only into the discharge port but further into the auxiliary cylindrical part, the content can be prevented from being pressed out of the discharge port by the seal part and from adhering to the seal part.

In addition, by configuring the seal part to extend into the auxiliary cylindrical part so as to be fitted integrally into both the discharge port and the auxiliary cylindrical part, it can be ensured that the content is prevented from being unintentionally leaked out of the discharge port with the over-cap being closed.

The inside plug member may include a cylindrical communicating part whose interior defines the communication port, an externally-fitted cylindrical part to which the valve body is connected via the elastic connecting pieces may be externally fitted to the cylindrical communication part, and the elastic connecting pieces may extend gradually outward with respect to the internal container along the axial direction, from the valve body side toward the externally-fitted cylindrical part side.

In this configuration, since the elastic connecting pieces extend gradually outward with respect to the internal container along the axial direction, from the valve body side toward the externally-fitted cylindrical part side, when the valve body is elastically displaced outward with respect to the internal container along the axial direction, an elastic restoring force can be efficiently exerted on the valve body.

Since the elastic restoring force can be efficiently exerted on the valve body as described above, when, for example, the dispensing container is unintentionally pressed slightly radially inward, the valve body can be prevented from being actuated. With such a configuration, it becomes possible to prevent the content from being discharged by an incorrect operation.

Since the elastic restoring force can be efficiently exerted on the valve body as described above, when the content is discharged and the pressing force of the content inside the internal container against the valve body is weakened, the valve body can be smoothly displaced so as to be restored toward the inner side of the internal container along the axial direction and it can therefore be ensured that the aforementioned effects and advantages are provided

Effects of the Invention

The dispensing container according to the present invention is capable of preventing, after the discharge of content, the content which has not been returned to the internal content from leaking out of the discharge port.

DETAILED DESCRIPTION OF PREFERRED EMBODIMENTS

A dispensing container according to an embodiment of the present invention will be described below with reference to the attached drawings.

Figure 1:
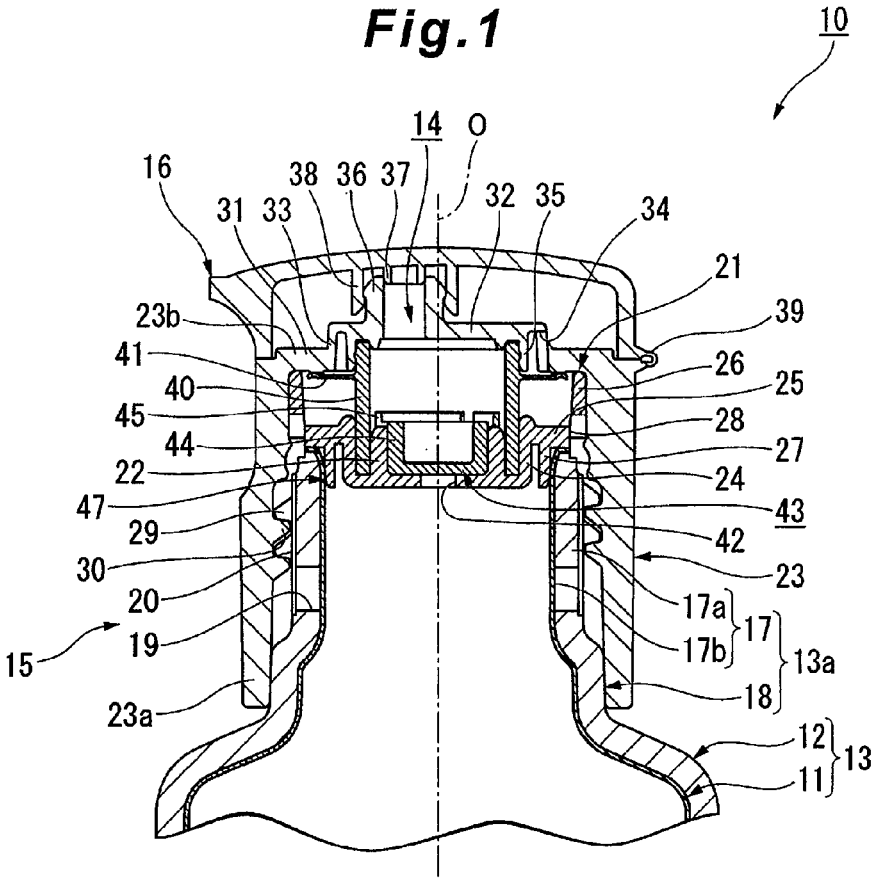
FIG. 1 is a vertical cross-sectional view showing a primary portion of a dispensing container according to an embodiment of the present invention.

As shown in FIG. 1, a dispensing container 10 includes: a container body 13 having a flexible internal container 11 which contains content M (see FIG. 4) and deforms so as to deflate with a decreasing amount of the content M, and an elastically-deformable external container 12 in which the internal container 11 is attached; a discharge cap 15 which is attached to a spout 13*a* of the container body 13 and provided with a discharge port 14 for discharging the content M; and an over-cap 16 which is removably arranged on the discharge cap 15.

The container body 13 is formed in a bottom-closed cylindrical shape and the over-cap 16 is formed in a top-closed cylindrical shape. The respective central axes of the container body 13 and over-cap 16 are arranged on a common axis in a state in which the container body 13 is being covered with the over-cap 16. In the following description: the common axis will be referred to as a container axis O; in a direction along this container axis O, the side of the over-cap 16 will be referred to as an upper side, while the side of a bottom (not shown) of the container body 13 will be referred to as a lower side; the direction orthogonal to the container axis O will be referred to as a radial direction; and the direction about the container axis O will be referred to as a circumferential direction.

The container body 13 is formed as a so-called "delamination bottle" in which the internal container 11 is layered on an inner surface of the external container 12 in a delaminatable manner. The container body 13 is molded by, for example, blow-molding a co-extruded two-layered parison. The external container 12 is made of, for example, polyethylene resin, polypropylene resin, or the like, while the internal container 11 is made of, for example, a material incompatible with the resin forming the external container 12, such as a polyamide-based synthetic resin or an ethylene-vinyl-alcohol copolymer resin.

The spout 13*a* of the container body 13 is formed as a stepped cylindrical shape having an upper cylindrical part 17 located on the upper side and a lower cylindrical part 18 located on the lower side and formed so as to have a diameter larger than that of the upper cylindrical part 17.

In the upper cylindrical part 17, an outer peripheral surface of a portion (hereinafter referred to as an external upper cylindrical part) 17*a*, which is constituted by the external container 12, is provided with an external thread 29. In the external upper cylindrical part 17*a*, a suction port 19 is provided at a position lower than the external thread 29, the suction port 19 introducing the external air in between the external container 12 and the internal container 11. A communication groove 20 extending in the container axis O direction is formed in a portion located above the suction port 19 in the external thread 29.

An inner peripheral surface of the external upper cylindrical part 17*a* is defined as a cylindrical surface, and a portion (hereinafter referred to as an internal upper cylindrical part) 17*b*, which is constituted by the internal container 11, in the upper cylindrical part 17 is layered on the inner peripheral surface of the upper cylindrical part 17*a*. An upper end portion of the internal upper cylindrical part 17*b* is folded radially outward and arranged at an opening end of the external upper cylindrical part 17*a*.

The discharge cap 15 includes: an inside plug member 21 which closes the spout 13*a* of the container body 13; and a cylindrical body member 23 formed in a top-closed cylindrical shape, the cylindrical body member 23 covering the inside plug member 21 and being provided with the discharge port 14.

The inside plug member 21 includes: a plug body 47 having the outer circumferential end thereof arranged at the opening end of the spout 13*a* of the container body 13; and a cylindrical communicating part 22 which is formed upright from the plug body 47.

The plug body 47 includes: a bottom-closed internal cylindrical part 24 which is arranged in the spout 13*a* of the container body 13 with a gap between the internal cylindrical part 24 and the spout 13*a*; a flange 25 which is formed so as to protrude radially outward from an upper end of the internal cylindrical part 24 and arranged at the opening end of the spout 13*a* of the container body 13; an external cylindrical part 26 extending upward from an outer circumferential edge of the flange 25; and a middle cylindrical part 27 extending downward from the flange 25 so as to surround the internal cylindrical part 24 from the radially outer side, the middle cylindrical part 27 being fitted into the spout 13*a* of the container body 13 in a liquid-tight manner.

Such internal cylindrical part 24, flange 25, external cylindrical part 26 and middle cylindrical part 27 are arranged coaxially with the container axis O. An external-air passage port 28 is formed at a lower end of the external cylindrical part 26, the external-air passage port 28 extending therethrough in the radial direction and opening downward.

The above-mentioned cylindrical communicating part 22 is arranged at a bottom wall of the internal cylindrical part 24. In addition, a through hole 42 is formed thorough the bottom wall, the through hole 42 opening into both the internal container 11 and the cylindrical communicating part 22. The through hole 42 is arranged coaxially with the container axis O and has a smaller diameter than the internal diameter of the cylindrical communicating part 22. The dimension along the container axis O of the through hole 42 is smaller than the dimension along the container axis O of the cylindrical communicating part 22.

The cylindrical body member 23 is arranged coaxially with the container axis O and formed in a top-closed cylindrical shape.

An inner peripheral surface of a peripheral wall 23*a* of the cylindrical body member 23 is provided with an internal thread 30 which is screwed with the external thread 29 in the spout 13*a* of the container body 13. A lower cylindrical part 18 in the spout 13*a* of the container body 13 is fitted in an airtight manner into a lower end portion located below a threaded portion, in which the internal thread 30 is formed, in the peripheral wall 23*a*, and the external cylindrical part 26 of the inside plug member 21 is fitted into an upper end portion located above the threaded portion.

A top wall 23*b* of the cylindrical body member 23 includes: an annular lower plate 31 which extends radially inward from an upper end of the peripheral wall 23*a*; an upper plate 32 which has a smaller diameter than the internal diameter of the lower plate 31 and which is arranged above the lower plate 31; and an annular connecting part 33 which connects the inner circumferential edge of the lower plate 31 and the outer circumferential edge of the upper plate 32 to each other. Such lower plate 31, upper plate 32 and annular connecting part 33 are arranged coaxially with the container axis O.

The annular connecting part 33 is provided with an external-air inlet port 34 which communicates between the cylindrical body member 23 and the outside. The upper plate 32 is provided with a cylindrical receiver 35 which extends downward and has an internal diameter approximately the same as the internal diameter of the internal cylindrical part 24 of the inside plug member 21.

The upper plate 32 is further provided with a discharge pipe 36 which extends therethrough, the inside of the discharge pipe 36 defining the discharge port 14.

Note that an inner cylindrical seal part (seal part) 37 which extends downward from the over-cap 16 is fitted into the discharge port 14. An outer cylindrical seal part 38 which extends downward from the over-cap 16 is fitted externally with the discharge pipe 36. In addition, in the illustrated example, the axis of the discharge pipe 36 is radially displaced from the container axis O, and a hinge 39 for connecting the discharge cap 15 and the over-cap 16 to each other is provided on the radially opposite side of the discharge pipe 36 with the container axis O therebetween.

As described above, the axial direction of the discharge port 14 and the container axis O direction coincide with each other.

An externally-fitted cylindrical part 40, which is externally fitted with the cylindrical communicating part 22 of the inside plug member 21, is arranged between the inside plug member 21 and the cylindrical body member 23. The externally-fitted cylindrical part 40 is arranged coaxially with the container axis O. A lower end portion of the externally-fitted cylindrical part 40 is externally fitted with the cylindrical communicating part 22 and also fitted into the internal cylindrical part 24 of the inside plug member 21. An upper end portion of the externally-fitted cylindrical part 40 is fitted into the cylindrical receiver 35 of the cylindrical body member 23.

An annular air valve 41 is provided in the middle in the container axis O direction of the externally-fitted cylindrical part 40, so as to protrude radially outward. The air valve 41 is arranged so as to cover the space between the cylindrical receiver 35 and the annular connecting part 33 from below. The air valve 41 is elastically deformable and switches between the communicated state and the shutoff state of the communication between the suction port 19 and the external-air inlet port 34.

The inside plug member 21 is provided with a communication port 43 which communicates between the discharge port 14 and the internal container 11. The communication port 43 is defined by the interior of the cylindrical communicating part 22 and is arranged coaxially with the container axis O. With such configuration, the container axis O direction and the axial direction of the communication port 43 coincide with each other. In the illustrated example, the communication port 43 is located below the discharge port 14, i.e., on the inner side of the internal container 11 along the container axis O direction. In addition, the internal volume of the communication port 43 is larger than the internal volume of the discharge port 14.

In this embodiment, a valve body 44 is arranged and fitted into the communication port 43 so as to be slidable along the container axis O direction, the valve body 44 being elastically displaced along the container axis O direction so as to open and close the communication port 43.

The valve body 44 is formed in a bottom-closed cylindrical shape and arranged coaxially with the container axis O. The bottom surface of the valve body 44 abuts onto a portion located on a radially inner side with respect to the cylindrical communicating part 22 in the bottom wall of the internal cylindrical part 24 in the plug body 47 of the inside plug member 21. This bottom surface is located on an opening plane on an upper end of the through hole 42 and shuts off the communication between the through hole 42 and the communication port 43.

Figure 2:
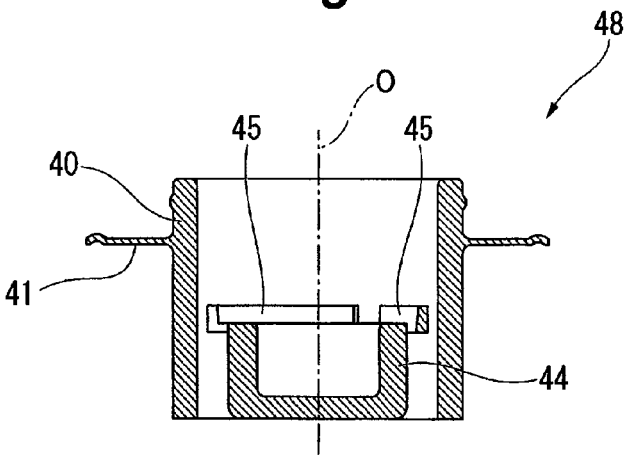
FIG. 2 is a vertical cross-sectional view showing a connector included in the dispensing container shown in FIG. 1.
Figure 3:
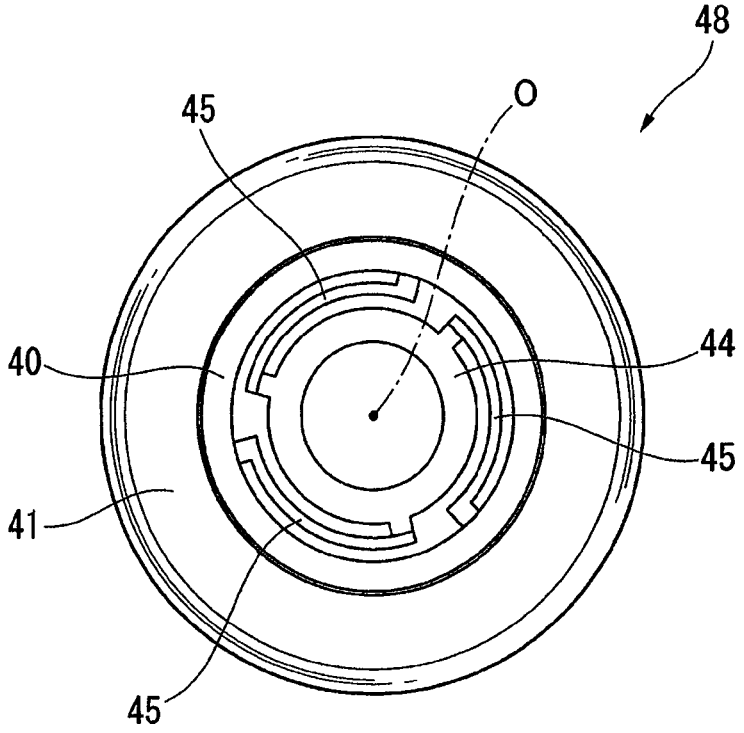
FIG. 3 is a top view of the connector shown in FIG. 2.
Figure 9:
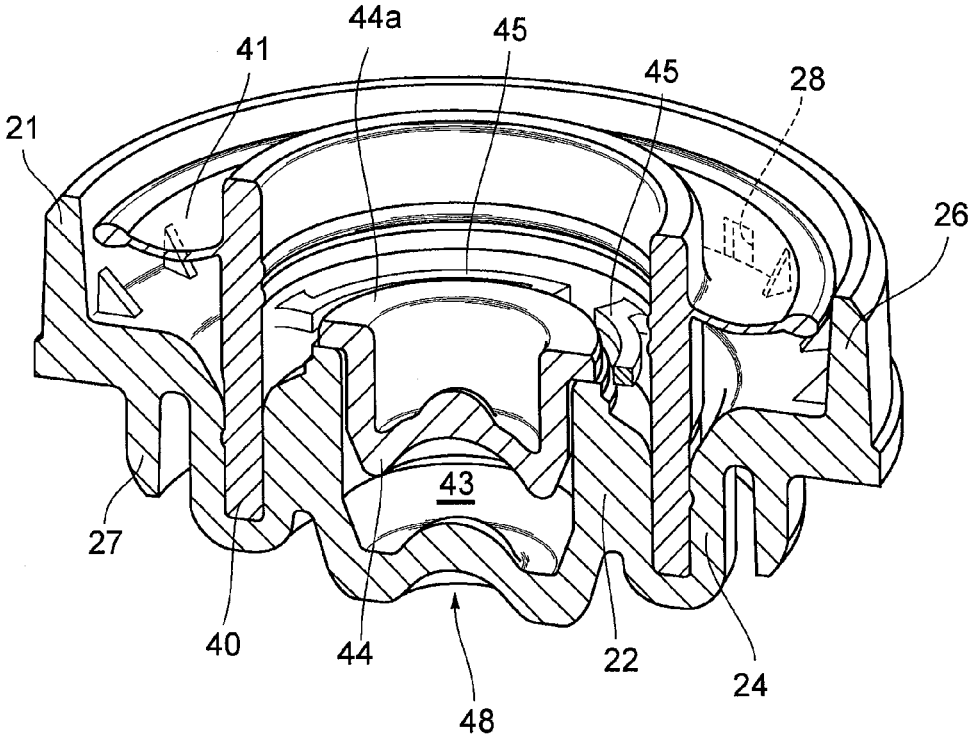
FIG. 9 is a perspective view showing an example of a cross-sectional structure of a connector, etc. included in a dispensing container according to an embodiment of the present invention.

An upper end of the valve body 44 is located above the upper end of the cylindrical communicating part 22 and, as shown in FIGS. 2 and 3, the upper end of the valve body 44 (in an embodiment shown in FIG. 9, a flange 44*a* of the valve body 44) is connected to one end of each of a plurality of elastic connecting pieces 45 which connect the valve body 44 and the externally-fitted cylindrical part 40 to each other. The plurality of elastic connecting pieces 45 (in the illustrated example, three elastic connecting pieces 45) are arranged circumferentially with gaps therebetween, each of which is circumferentially curved. The positions of both ends of each connecting piece 45 approximately coincide with each other in the container axis O direction.

Note that the valve body 44, the externally-fitted cylindrical part 40, the elastic connecting pieces 45 and the air valve 41 are integrally formed so as to constitute a connector 48.

The elastic connecting pieces 45 are elastically deformed so as to allow the valve body 44 to be displaced along the container axis O direction. (Note that, in this specification, such situation in which the elastic connecting pieces 45 are elastically deformed while allowing the valve body 44 to be displaced is expressed as "elastic displacement."). When there is a plurality of (three in the illustrated example) elastic connecting pieces 45, as in this embodiment, these elastic connecting pieces 45 are preferably arranged circumferentially at regular intervals (see FIG. 3). By arranging the elastic connecting pieces 45 at regular intervals, the valve body 44, being elastically displaced, will not be tilted (misaligned) with respect to a plane orthogonal to the container axis O, and in this way a smooth displacement of the valve body 44 can be promoted (see FIGS. 9 and 10).

Figure 10:
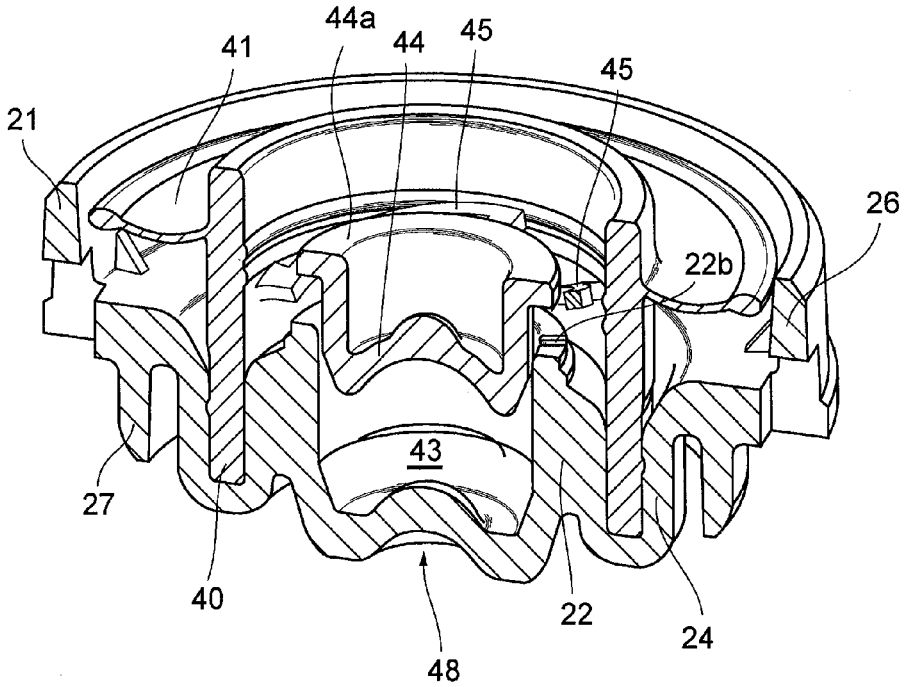
FIG. 10 is a perspective view showing a state in which a valve body shown in FIG. 9 has been elastically displaced.

When the valve body 44 is elastically displaced, each elastic connecting piece 45 is partially turned and elastically deformed and the entire elastic connecting piece 45 becomes tilted (see FIG. 10). At this time, a part of the elastic connecting piece 45 itself is twisted and the entire elastic connecting piece 45 is stretched depending on the state of elastic displacement, and an elastic restoring force of the elastic connecting piece 45 acts as a force for causing the valve body 44 to be displaced so as to be restored (restored) to the original position before the displacement. It should be noted that, when the valve body 44 is elastically displaced or displaced so as to be restored, the valve body 44 may be rotated circumferentially (clockwise or counterclockwise) about the container axis O.

The elastic connecting pieces 45 in this embodiment are each curved circumferentially, as described above, and simply housed in a small gap between the valve body 44 and the externally-fitted cylindrical part 40 (in the embodiment shown in FIG. 9, between the flange 44*a* of the valve body 44 and the inner peripheral surface of the externally-fitted cylindrical part 40) in a state in which the valve body 44 is located on the opening plane on the upper end of the through hole 42 (the state in which the valve body 44 has been displaced so as to be restored toward the inner side of the internal container 11 along the container axis O direction).

Next, the effect of the dispensing container 10 having the above configurations will be described below.

Figure 4:
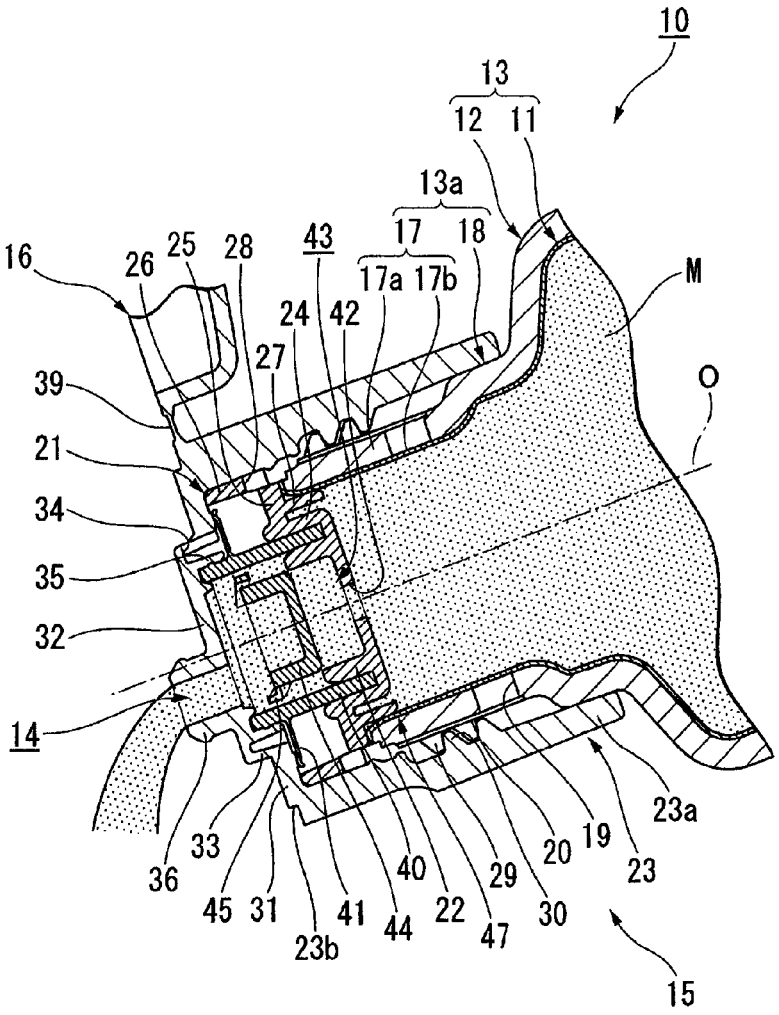
FIG. 4 is a vertical cross-sectional view explaining the effect of the dispensing container shown in FIG. 1.

As shown in FIG. 4, when the content M is discharged from the dispensing container 10, the over-cap 16 is first removed from the discharge cap 15. Then, in a state in which the dispensing container 10 is tilted in a discharge posture so that the discharge port 14 is directed downward, the dispensing container 10 is pressed radially inward so as to be squeezed and deformed (elastically deformed), and the internal container 11 is deformed together with the external container 12 so as to reduce the volume thereof.

As a result, the pressure inside the internal container 11 increases so as to cause the content M in the internal container 11 to press the valve body 44 via the through hole 42, the elastic connecting pieces 45 are elastically deformed so as to cause the valve body 44 to be elastically displaced along the container axis O direction toward the outside of the internal container 11, and the communication port 43 is opened. As a result, the content M in the internal container 11 is discharged via the through hole 42, the communication port 43, the externally-fitted cylindrical part 40 and the discharge port 14, to the outside.

Then, by stopping or releasing the pressing against the dispensing container 10 so as to weaken the pressing force of the content M in the internal container 11 against the valve body 44, the elastic restoring force of the elastic connecting pieces 45 causes the valve body 44 to be displaced so as to be restored along the container axis O direction toward the inner side of the internal container 11.

Figure 5:
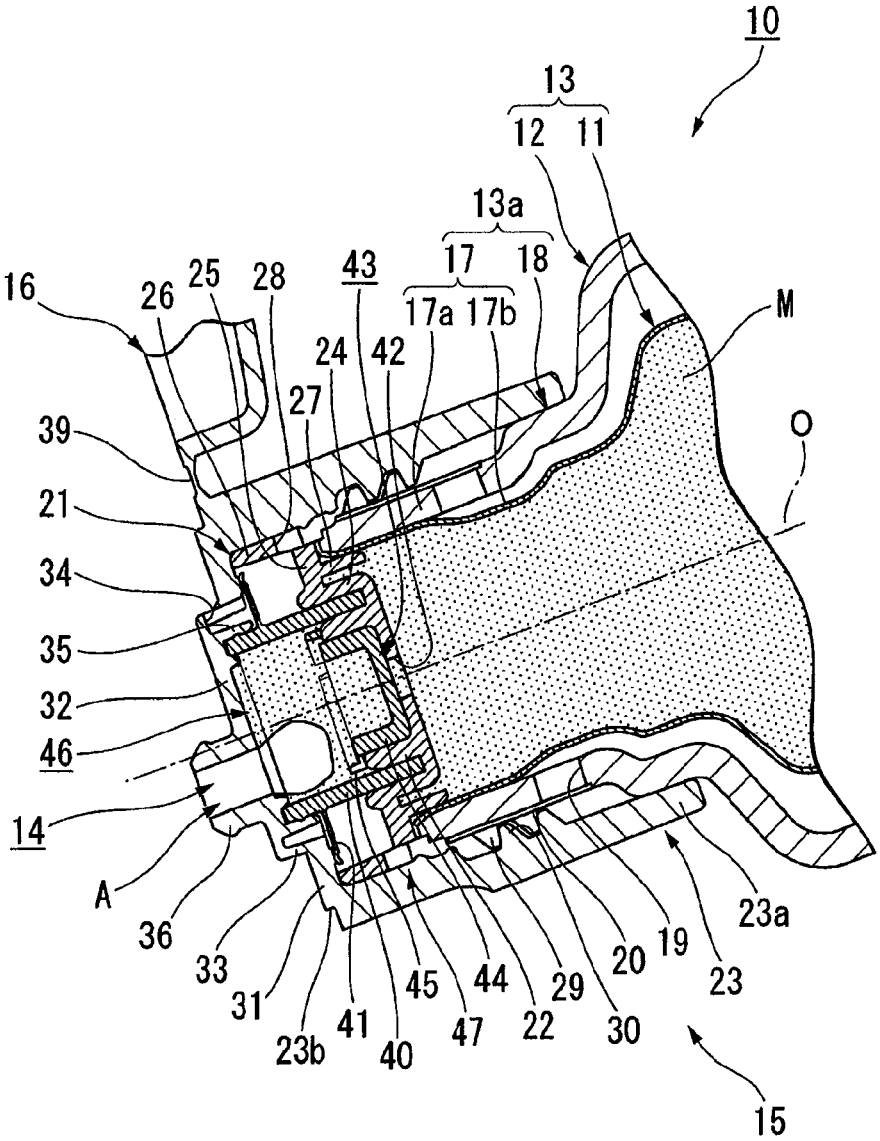
FIG. 5 is a vertical cross-sectional view explaining the effect of the dispensing container shown in FIG. 1.

At this time, when the valve body 44 enters the communication port 43, as shown in FIG. 5, the outer peripheral surface of the valve body 44 is brought into contact with and slid along the inner peripheral surface of the communication port 43 so as to thereby close the communication port 43. As a result, an internal space 46, in which the content M which has not been returned to the internal container 11 remains, is formed between the cylindrical body member 23 and the inside plug member 21. The internal space 46 communicates with the discharge port 14 and has the valve body 44 as a part of its delimiting walls. The valve body 44 shuts off the communication between the internal space 46 and the communication port 43.

When, after the internal space 46 is formed as described above, the valve body 44 continues the restoration displacement and slides in the communication port 43 along the container axis O direction, the internal volume of the internal space 46 increases as the restoration displacement of the valve body 44 proceeds. Accordingly, it becomes possible to introduce the content M in the discharge port 14 into the internal space 46 and to suck the external air into the discharge port 14.

When the pressing against the container body 13 is released in the state where the communication port 43 is being shut off by the valve body 44, the external container 12 will be restored to the original shape while the internal container 11 remains deformed with the reduced volume. At this time, negative pressure is generated between the internal container 11 and the external container 12, and the negative pressure acts on the air valve 41 via the suction port 19 and causes the air valve 41 to be opened. Then, external air is introduced in between the external container 12 and the internal container 11 via the external-air inlet port 34, the external-air passage port 28, the communication groove 20 and the suction port 19. When the internal pressure between the external container 12 and the internal container 11 increases so as to match the atmospheric pressure, the air valve 41 is restored to the original shape and shuts off the suction port 19 from the outside. As a result, the reduced-volume shape of the internal container 11 is retained after the discharge of the content M.

From this state, when the external container 12 of the container body 13 is squeezed and deformed again, the internal pressure between the external container 12 and the internal container 11 becomes positive due to the shutoff state of the air valve 41, and this positive pressure causes the internal container 11 to be deformed so as to reduce the volume thereof and the content M is discharged due to the aforementioned effect.

If, after the content M is discharged and before the communication port 43 is shut off by the valve body 44, the pressing against the dispensing container 10 is not only stopped but also released, the internal container 11 will be restored to the original shape by following the behavior of the external container 12. Then, the pressure inside the internal container 11 will decrease to a negative pressure and this negative pressure will act on the valve body 44, so that the valve body 44 is smoothly displaced so as to be restored along the container axis O direction toward the inner side of the internal container 11.

As described above, since the dispensing container 10 according to this embodiment allows, after the discharge of the content M, the content M in the discharge port 14 to be introduced into the internal space 46 and allows the external air A to be sucked into the discharge port 14, it becomes possible to prevent the content M which has not been returned to the internal container 11 from remaining in the discharge port 14. With such configuration, the content M can be prevented from leaking out of the discharge port 14 after the discharge of the content M.

In addition, since the through hole 42 has a smaller diameter than that of the communication port 43, even if the valve body 44 is unintentionally displaced toward the inner side of the internal container 11 along the axial direction, the valve body 44 will still abut onto the portion located on the radially inner side of the plug body 47 with respect to the cylindrical communicating part 22 and such an unintentional displacement of the valve body 44 will still be able to be restricted.

If the valve body 44 abuts onto the plug body 47 when the dispensing container 10 is not being operated as in this embodiment, the communication between the communication port 43 and the through hole 42 can be shut off by the valve body 44.

In this case, when the valve body 44 is displaced so as to be restored after the content M is discharged and the internal space 46 is formed as described above, the valve body 44 can be slid in the communication port 43 over its entire length, along the container axis O direction. This can ensure that the internal volume of the internal space 46 increases and the aforementioned effects and advantages can be significantly exerted.

Since the inner cylindrical seal part 37 is provided in the over-cap 16, the content M can be prevented from being unintentionally leaked out of the discharge port 14 with the over-cap 16 being closed.

After the discharge of the content M, the content M, which has not been returned to the internal container 11, hardly remains in the discharge port 14, as described above. Thus, when the over-cap 16 is attached onto the discharge cap 15 after the discharge of the content M and the inner cylindrical seal part 37 is fitted into the discharge port 14, the content M can be prevented from being pressed out from the discharge port 14 by the inner cylindrical seal part 37 and the content M can be prevented from adhering to the inner cylindrical seal part 37.

It should be noted that the technical scope of the present invention is not limited to the embodiment above and various modifications may be added without departing from the gist of the present invention.

Figure 6:
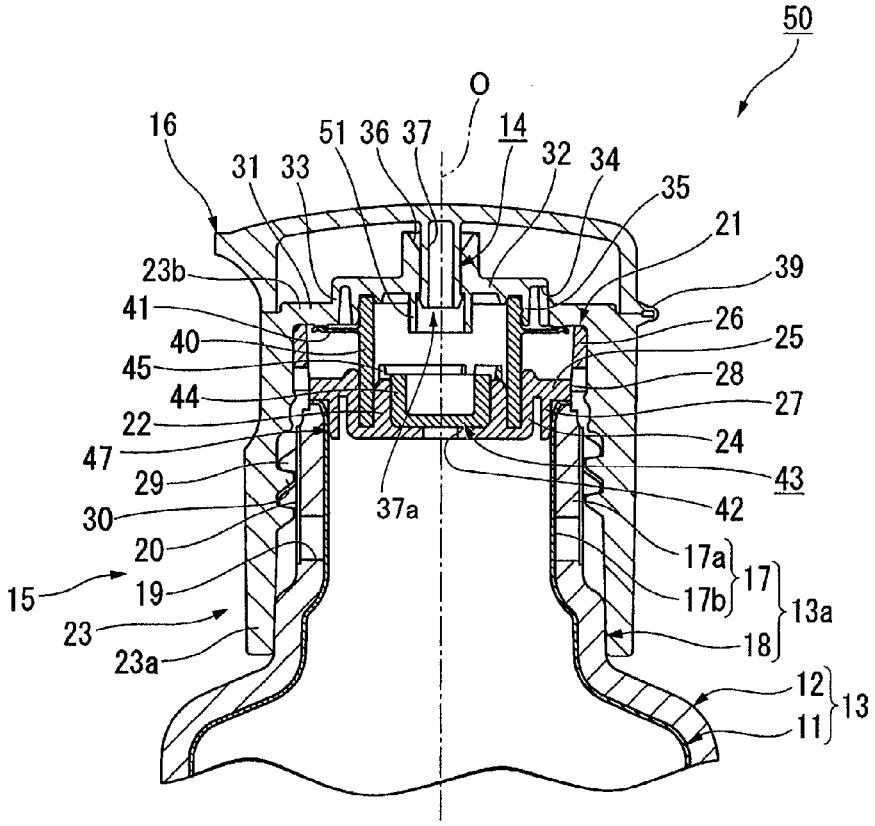
FIG. 6 is a vertical cross-sectional view showing a primary portion in an example modification of a dispensing container according to an embodiment of the present invention.

For example, the discharge port 14 may be arranged coaxially with the container axis O as in a dispensing container 50 shown in FIG. 6. The axis of the discharge port 14 may be tilted with respect to the container axis O.

In addition, as in the dispensing container 50 shown in FIG. 6, an auxiliary cylindrical part 51 which communicates with the discharge port 14 is provided on a circumferential edge of the opening of the discharge port 14 in the cylindrical body member 23 so as to protrude toward the communication port 43. The auxiliary cylindrical part 51 protrudes downward, i.e., toward the communication port 43, along the container axis O direction, and a lower end 37*a* of the inner cylindrical seal part 37 is fitted into this auxiliary cylindrical part 51. In other words, the inner cylindrical seal part 37 is integrally fitted into both the discharge port 14 and the auxiliary cylindrical part 51.

Figure 7:
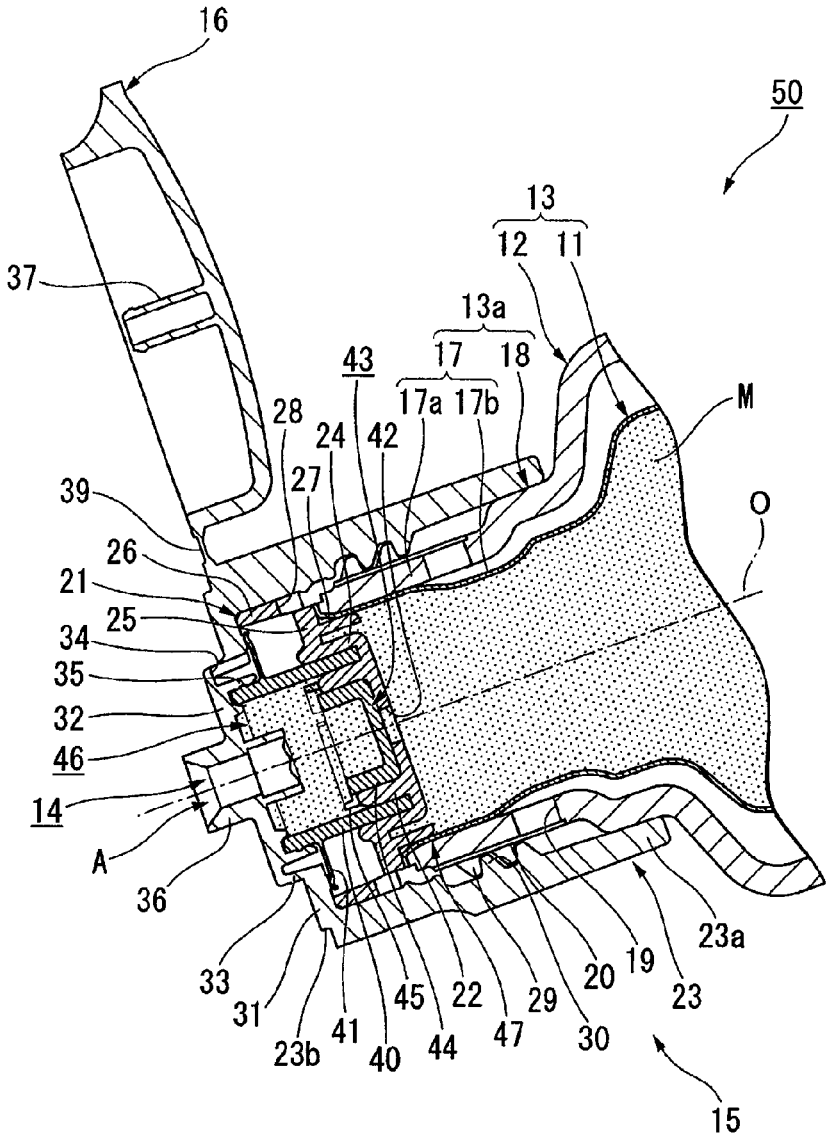
FIG. 7 is a vertical cross-sectional view explaining the effect of the dispensing container shown in FIG. 6.

In this dispensing container 50, since the auxiliary cylindrical port 51 which communicates with the discharge port 14 is provided on the circumferential edge of the opening of the discharge port 14 in the cylindrical body member 23 so as to protrude toward the communication port 43, when the external air A is sucked into the discharge port 14 after the discharge of the content M and the air A is introduced through the discharge port 14 further toward the communication port 43, the external air A will be introduced into the auxiliary cylindrical part 51, as shown in FIG. 7. The external air A introduced into the auxiliary cylindrical part 51 will be introduced further deeply toward the communication port 43 along the container axis O direction, being the axial direction of the discharge port 14, so that the external air A will become hardly dispersible in the radial direction of the discharge port 14.

Accordingly, by introducing the external air A not only into the discharge port 14 but further into the auxiliary cylindrical part 51 and preventing the content M which has not been returned to the internal container 11 from remaining in the discharge port 14 and in the auxiliary cylindrical part 51 after the discharge of the content M, it becomes possible to efficiently prevent the content M from leaking out of the discharge port 14.

Since it is possible to prevent the content M which has not been returned to the internal container 11 from remaining in the discharge port 14 and in the auxiliary cylindrical part 51 after the discharge of the content M, as described above, even if the inner cylindrical seal part 37 extends not only into the discharge port 14 but further into the auxiliary cylindrical part 51, the content M can be prevented from being pressed out of the discharge port 14 by the inner cylindrical seal part 37 and from adhering to the inner cylindrical seal part 37.

By configuring the inner cylindrical seal part 37 to extend into the auxiliary cylindrical part 51 so as to be fitted into both the discharge port 14 and the auxiliary cylindrical part 51, it can be ensured that the content M is prevented from being unintentionally leaked out of the discharge port 14 with the over-cap 16 being closed.

Figure 8:
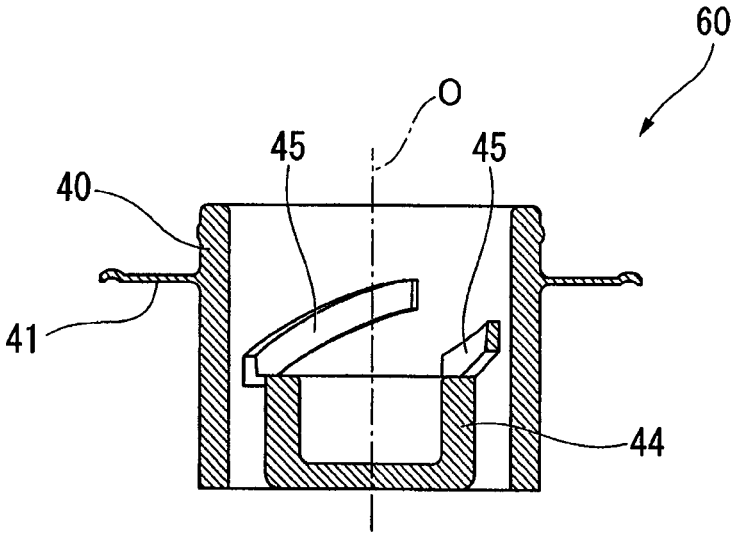
FIG. 8 is a vertical cross-sectional view showing a connector included in an example modification of a dispensing container according to an embodiment of the present invention.

Although the positions of both ends of each elastic connecting piece 45 approximately coincide with each other in the container axis O direction in the above embodiment, the positions are not limited thereto. For example, as in a connector 60 shown in FIG. 8, the elastic connecting pieces 45 may extend gradually outward with respect to the internal container 11 along the container axis O direction, from the valve body 44 side toward the externally-fitted cylindrical part 40 side.

In a dispensing container having such connector 60, since the elastic connecting pieces 45 extend gradually outward with respect to the internal container 11 along the container axis O direction, from the valve body 44 side toward the externally-fitted cylindrical part 40 side, when the valve body 44 is elastically displaced toward the outside of the internal container 11 along the container axis O direction, an elastic restoring force can be efficiently exerted on the valve body 44.

Since the elastic restoring force can be efficiently exerted on the valve body 44, as described above, when, for example, the dispensing container is unintentionally pressed slightly radially inward, the valve body 44 can be prevented from being actuated. With such a configuration, it becomes possible to prevent the content M from being discharged by an incorrect operation.

Since the elastic restoring force can be efficiently exerted on the valve body 44, as described above, when the content M is discharged and the pressing force of the content M inside the internal container 11 against the valve body 44 is weakened, the valve body 44 can be smoothly displaced so as to be restored toward the inner side of the internal container 11 along the container axis O direction and it can therefore be ensured that the aforementioned effects and advantages are provided.

Although, in the embodiment above, the dispensing container 10 is tilted in a discharge posture so that the discharge port 14 is directed downward and then the dispensing container 10 is pressed radially inward and squeezed so as to be deformed in order to discharge the content M from the dispensing container 10, the configuration is not limited thereto. For example, the dispensing container 10 may be configured to, for example, discharge the content M from the discharge port 14 only by tilting the dispensing container 10 in the discharge posture. In such case, it is possible to employ a configuration in which, for example, the elastic connecting pieces are elastically deformed by the weight of content M which is exerted on the valve body 44 in the discharge posture.

Although the over-cap 16 is connected via the hinge 39 to the discharge cap 15 in the embodiment above, the configuration is not limited thereto. The over-cap 16 may, for example, be configured to be removably fitted into an undercut in the discharge cap 15.

Although the inner cylindrical seal part 37 fitted into the discharge port 14 is formed in a cylindrical shape in the embodiment above, it may not be cylindrical but may be, for example, a solid pin-like shape.

In addition, the inner cylindrical seal part 37, the outer cylindrical seal part 38 and the over-cap 16 may not be provided.

Although the valve body 44 may be formed in a bottom-closed cylindrical shape, the shape is not limited thereto. For example, the valve body 44 may be formed in a solid block shape, a plate-like shape, a top-closed cylindrical shape having no bottom wall, and so on. The valve body 44 may have any shape, without limitation, as long as it is capable of switching between the communicated state and shutoff state of the communication between the discharge port 14 and the internal container 11.

Although the communication port 43 is arranged coaxially with the container axis O in the embodiment above, the configuration is not limited thereto. For example, the axis of the communication port 43 and the container axis O may be arranged in parallel and radially displaced from each other. In addition, the axis of the communication port 43 may be tilted with respect to the container axis O. In such case, a valve body may be arranged and fitted in the communication port so as to be slidable along the axial direction and elastically displaced along the axial direction so as to open and close the communication port.

Although the communication port 43 is defined by the interior of the cylindrical communicating part 22 in the embodiment above, the configuration is not limited thereto. For example, the cylindrical communicating part 22 may not be provided and the communication port 43 may instead be constituted by the through hole 42. The communication port 43 may be tilted with respect to the container axis. In such case a valve body may be arranged in the through hole, the valve body being fitted in the through hole so as to be slidable along the axial direction, elastically displaced along the axial direction to open and close the communication port.

Although the internal thread 30 of the cylindrical body member 23 in the discharge cap 15 is configured so as to be screwed with the external thread 29 on the spout 13*a* of the container body 13 in the embodiment above, the configuration is not limited thereto. For example, the spout 13*a* of the container body 13 and the cylindrical body member 23 may be provided with respective fitting projections to be fitted into respective undercuts, to thereby attach the discharge cap 15 onto the spout 13*a*.

Although, in the embodiment above, the suction port 19 is formed in the external upper cylindrical part 17*a*, the air valve 41 is provided in the middle, in the container axis O direction, of the externally-fitted cylindrical part 40, and the external-air inlet port 34 is formed in the annular connecting part 33, the configuration is not limited thereto. For example, it is possible to employ a configuration in which the suction port is formed in the bottom of the external container, a bottom-closed cylindrical body provided with an external-air inlet port is externally attached in an air-tight manner to the bottom of the external container, and the bottom-closed cylindrical body is provided with an air valve.

Although the container body 13 is configured as a so-called "delamination bottle" in which the internal container 11 is layered on the inner surface of the external container 12 so as to be delaminatable in the embodiment above, the configuration is not limited thereto. For example, the container body 13 may be a two-layered container in which an internal container and an external container are formed separately.

Figure 11:
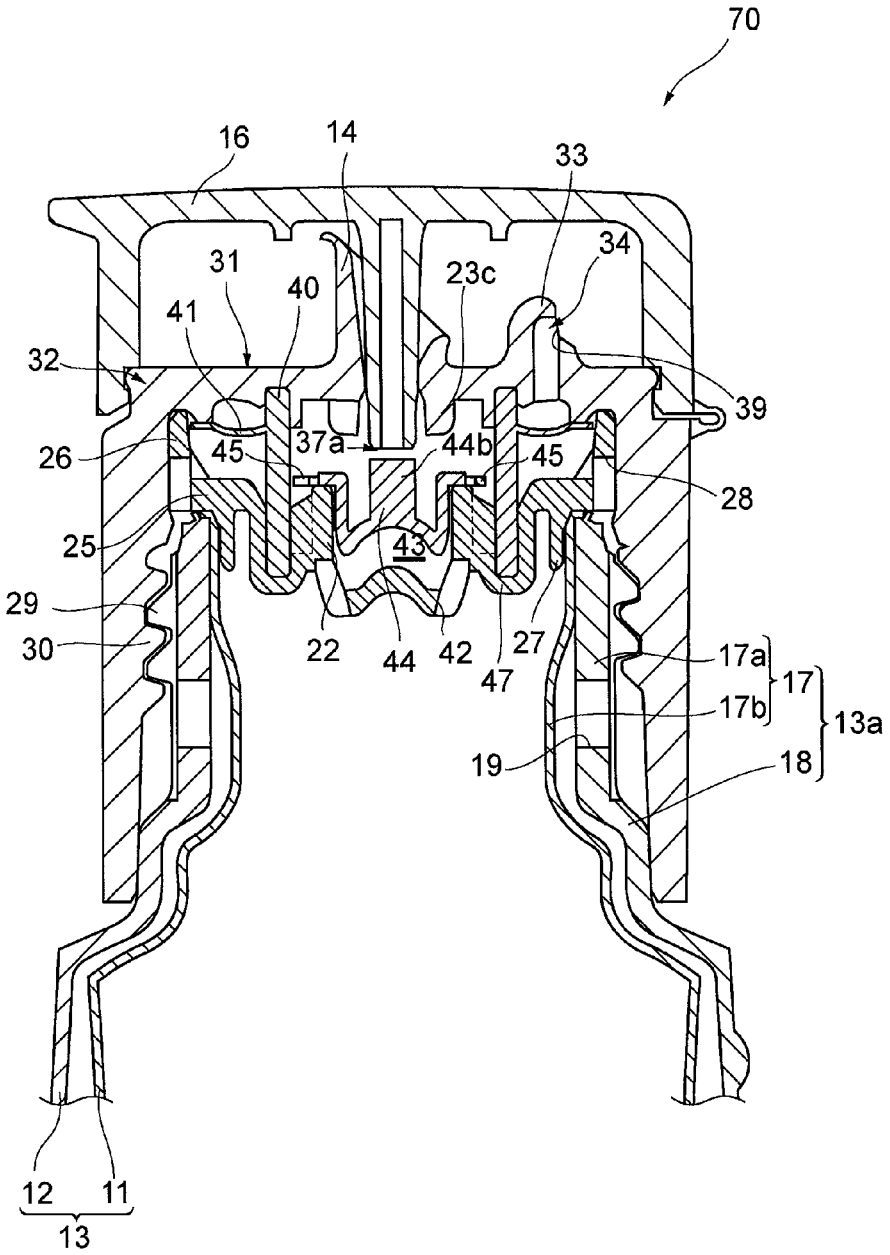
FIG. 11 is a vertical cross-sectional view showing a primary portion of an example modification of a dispensing container according to an embodiment of the present invention.

Although the specific shape of the inner cylindrical seal part 37 which extends downward from the over-cap 16 has not been mentioned in the embodiment above, the inner cylindrical seal part 37 is preferably formed so as to have such a length and shape that it would suppress an elastic displacement of the valve body 44 in a covered state where the over-cap 16 is being closed. For example, in a dispensing container 70 shown in FIG. 11, an end (lower end 37*a*) of the inner cylindrical seal part 37 is configured so as to abut onto a portion of the valve body 44 in the covered state. The valve body 44 is provided with a projection 44*b* onto which the end of the inner cylindrical seal part 37 abuts (see FIG. 11).

The dispensing container 10 including the over-cap 16, as in the embodiment above, preferably has a structure for preventing the content M from overflowing when the over-cap is closed to provide the covered state. The following description will describe such structure by providing some specific examples (see FIG. 10).

Figure 12:
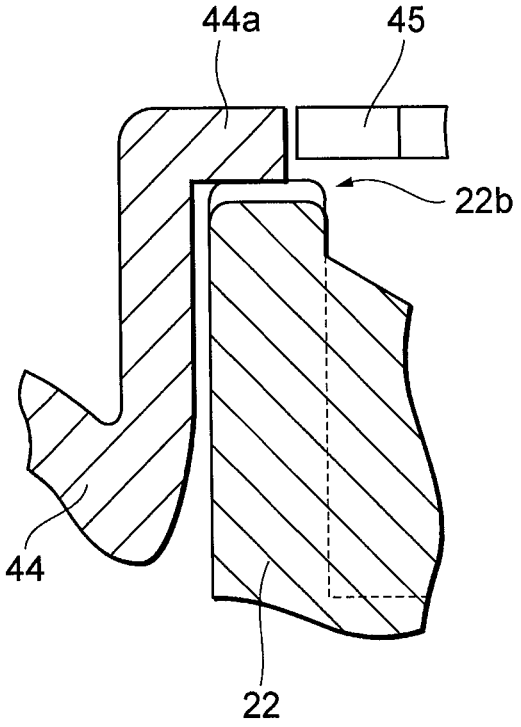
FIG. 12 is a view showing a part of the primary portion of the dispensing container shown in FIG. 11 in an enlarged manner.
Figure 13A:
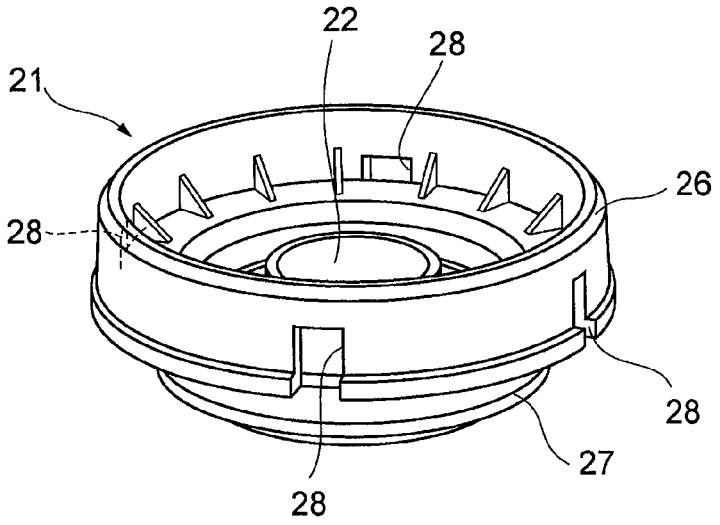
FIG. 13A is a perspective view of an inside plug member according to an embodiment of the present invention.
Figure 13B:
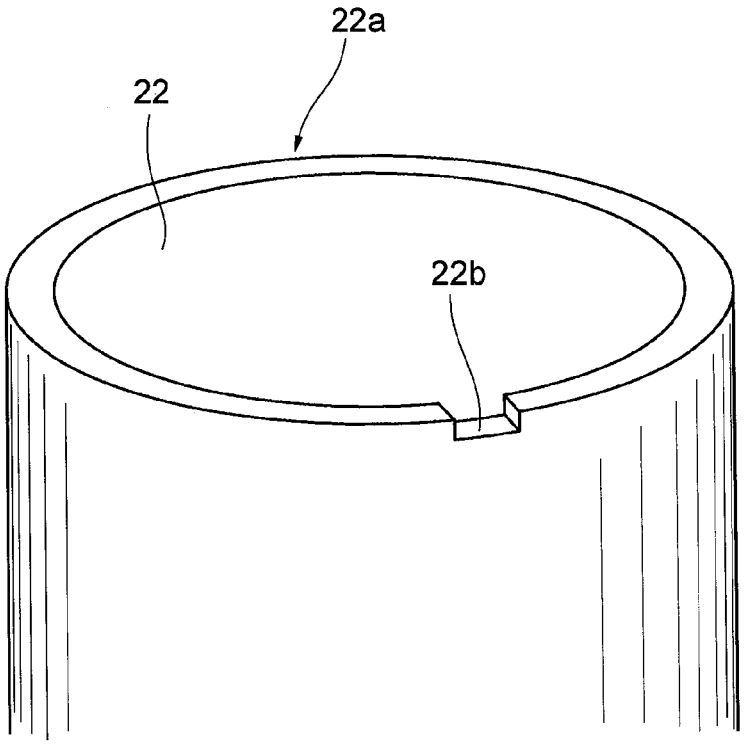
FIG. 13B is an enlarged perspective view showing a flow-allowing groove formed in a cylindrical communicating part of the inside plug member.

In the dispensing container 70 shown in FIG. 10, etc., an annular upper end surface of the cylindrical communicating part 22 functions as a valve seat (valve holder) 22*a* which abuts onto an annular flange 44*a* protruding radially outward from an upper end of the valve body 44 and receives the valve body 44. In this configuration, a bottom surface of the valve body 44 does not have to abut onto a portion located on the radially inner side with respect to the cylindrical communicating part 22 in the plug body 47. A flow-allowing groove 22*b* which allows the content M to flow therethrough may be formed in a portion of the valve seat 22*a* which comes into contact with the valve body 44 (FIGS. 10, 12, 13, etc.). The flow-allowing groove 22*b* preferably has a size that allows the content M remaining in the internal space 46 after the valve body 44 sits on the valve seat 22*a* to be returned to the internal container 11 and allows the content M, at the end of its being returned to the internal container 11, to clog the flow-allowing groove 22*b* (block the airflow) with its surface tension. It should be noted that it is only necessary to configure at least part of the content remaining in the internal space 46 to be returned to the internal container by the flow-allowing groove 22*b*.

The specific shape and number of the flow-allowing groove(s) 22*b* are not particularly limited.

In general, if the content M remains in the internal space 46 when the over-cap 16 is closed to provide the covered state, an effect may arise in which the content M is pressed out by the inner cylindrical seal part 37 which enters into the discharge port 14 to be fitted thereinto. However, in the dispensing container shown in FIG. 10, etc., the content M remaining near the discharge port 14 or in the internal space 46 can flow through the flow-allowing groove 22*b* to be returned to the internal container 11 through the through hole 42. Accordingly, it is possible to prevent the content M from overflowing and contaminating the inner side of the over-cap 16 and the surface of the discharge cap 15 when the over-cap 16 is closed to provide the covered state.

Figure 14:
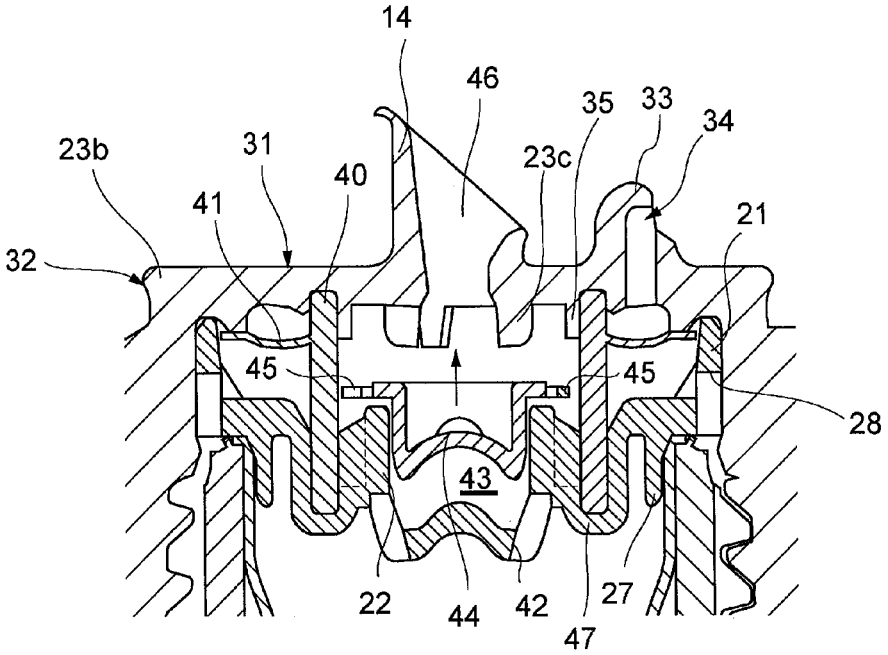
FIG. 14 is a vertical cross-sectional view showing a primary portion of an example modification of a dispensing container according to an embodiment of the present invention.
Figure 15:
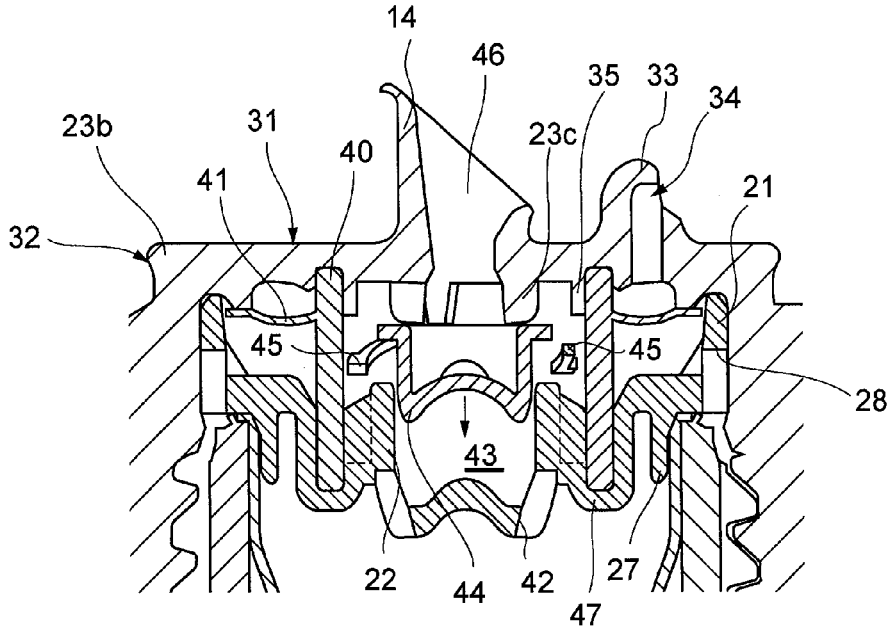
FIG. 15 is a vertical cross-sectional view showing a state in which a valve body shown in FIG. 14 has been elastically displaced.

In the embodiment above, no detailed explanation has been provided regarding restricting the amount of elastic displacement of the valve body 44. However, for example, a displacement amount restrictor (valve stopper) 23*c* for restricting the amount of elastic displacement of the valve body 44 may be formed in, for example, the cylindrical body member 23 (see FIGS. 11, 14 and 15). The displacement amount restrictor 23*c* may be constituted by, for example, a plurality of (e.g., three) protrusions formed around the discharge port 14 on a back surface of the top wall 23*b* (the surface facing the inner side) of the cylindrical body member 23 which is formed in a top-closed cylindrical shape (see FIG. 11, etc.).

By constituting the displacement amount restrictor 23*c* by way of a plurality of protrusions, as described above, the position for limiting the displacement of the valve body 44 can be restricted so that the discharge port is not closed even at that position and the content M can be ensured to flow between the protrusions.

Although the valve body 44 and the externally-fitted cylindrical part 40 are connected by the elastic connecting pieces 45 in the embodiment above, this is merely an example of preferred configurations. In some configurations of the dispensing container 10, the valve body 44 may be connected to a cylindrical member, other than the externally-fitted cylindrical part 40, which is arranged coaxially with the cylindrical communicating part 22. In short, the elastic connecting pieces 45 are capable of connecting the valve body 44 to a cylindrical member which houses the valve body 44 so as to be slidable therein, and the externally-fitted cylindrical part 40 in the embodiment above is merely an example of such cylindrical member.

In addition to the modifications mentioned above, the components in the embodiment above may be arbitrarily replaced with known components and the above-mentioned modifications may be combined with each other, without departing from the gist of the present invention.

The following description will describe an embodiment of a dispensing container capable of preventing content liquid which has, for example, dripped and adhered to the discharge cap, from being sucked into the external-air inlet port, as well as an embodiment of a dispensing container capable of allowing the content liquid which has, for example, dripped and adhered to the discharge cap, to be easily wiped off.

Figure 16:
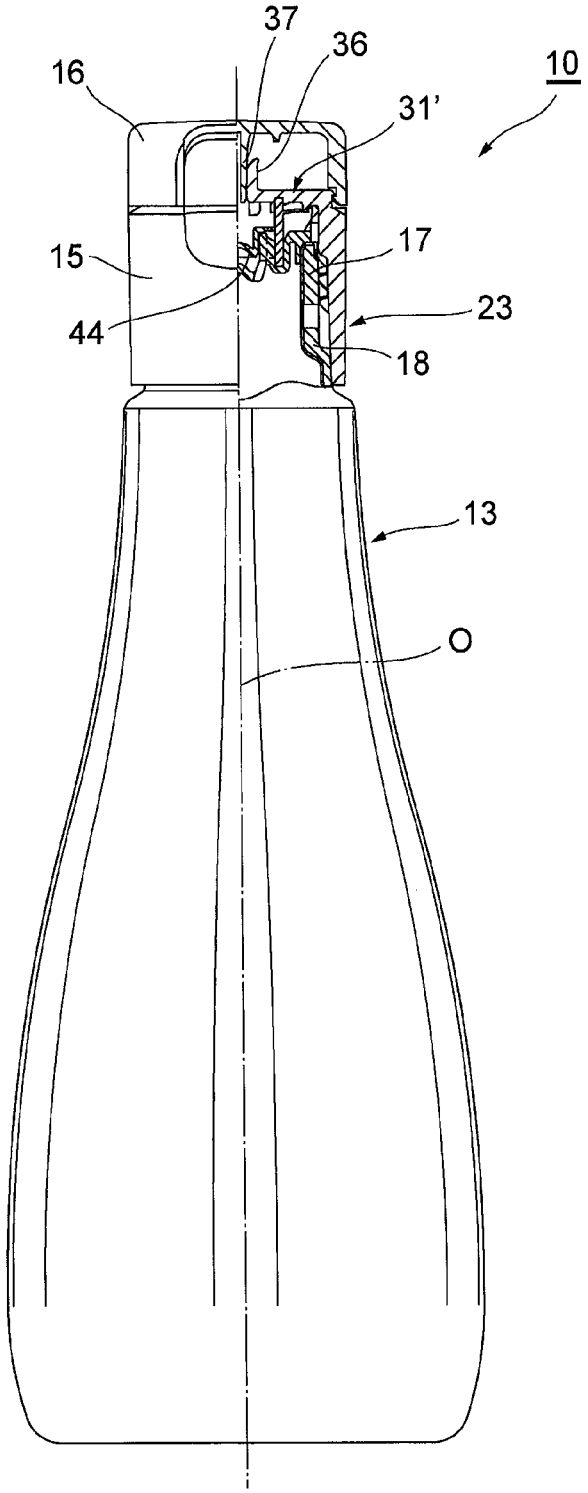
FIG. 16 is a partial cross-sectional view showing the entirety of a dispensing container according to an embodiment of the present invention.

As shown in FIG. 16, a dispensing container 10 includes: a container body 13 having a flexible internal container 11 which contains content M and deforms so as to deflate with a decreasing amount of the content M, and an elastically-deformable external container 12 in which the internal container 11 is attached; a discharge cap 15 which is attached to a spout

13*a* of the container body 13 and provided with a discharge pipe 36, the inner side of which defines a discharge port 14 for discharging the content M; and an over-cap 16 which is removably arranged on the discharge cap 15.

The container body 13 is formed in a bottom-closed cylindrical shape and the over-cap 16 is formed in a top-closed cylindrical shape. The respective central axes of the container body 13 and over-cap 16 are arranged on a common axis in a covered state where the over-cap 16 is being attached onto the discharge cap 15 (see FIG. 23). In the following description: the common axis will be referred to as a container axis O; in the direction along this container axis O, the side of the over-cap 16 will be referred to as an upper side, while the side of a bottom (not shown) of the container body 13 will be referred to as a lower side; the direction orthogonal to the container axis O will be referred to as a radial direction; and the direction about the container axis O will be referred to as a circumferential direction.

Figure 17:
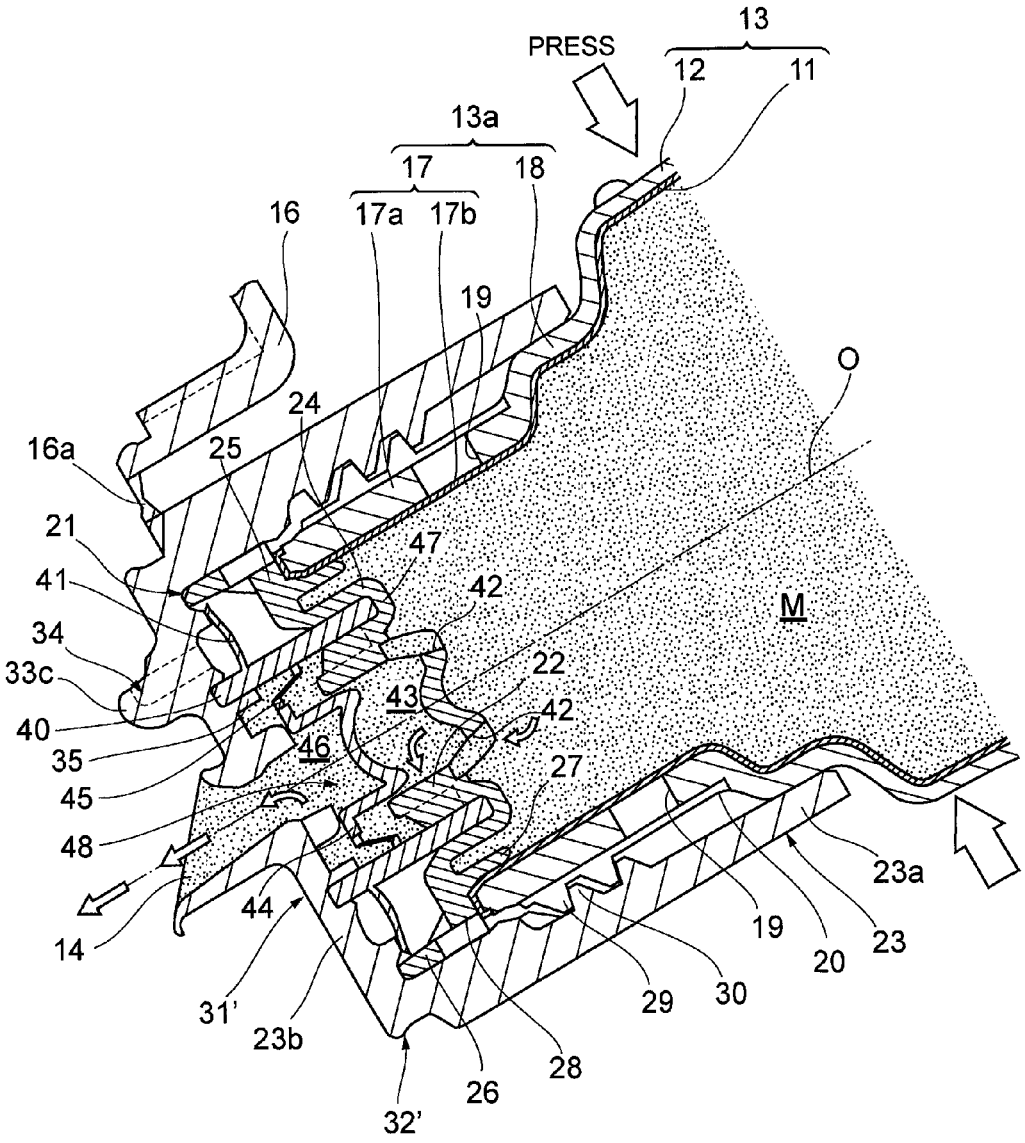
FIG. 17 is a vertical cross-sectional view explaining how the content in the dispensing container acts when being discharged therefrom.

The over-cap 16 may be connected via a hinge 16*a* to the discharge cap 15 (see FIG. 17). The hinge 16*a* is arranged at a position higher than the discharge port 14 in a state in which the dispensing container 10 is tilted in a discharge posture so as to direct the discharge port 14 downward, so that the over-cap 16 will not be an obstacle when the content M is discharged from the discharge port 14.

The container body 13 is formed as a so-called "delamination bottle," in which the internal container 11 is layered on an inner surface of the external container 12 so as to be delaminatable. The container body 13 is molded by, for example, blow-molding a co-extruded two-layered parison. The external container 12 is made of, for example, polyethylene resin, polypropylene resin, or the like, while the internal container 11 is made of, for example, a material incompatible with the resin forming the external container 12, such as a polyamide-based synthetic resin or an ethylene-vinyl-alcohol copolymer resin.

The spout 13*a* of the container body 13 is formed as a stepped cylindrical shape having an upper cylindrical part 17 located on the upper side and a lower cylindrical part 18 located on the lower side and formed so as to have a larger diameter than that of the upper cylindrical part 17 (see FIG. 17). In the upper cylindrical part 17, an outer peripheral surface of a portion (hereinafter referred to as an external upper cylindrical part) 17*a*, which is constituted from the external container 12, is provided with an external thread 29. In the external upper cylindrical part 17*a*, a suction port 19 is provided at a position lower than the external thread 29, the suction port 19 introducing the external air in between the external container 12 and the internal container 11 (see FIG. 18, etc.). A communication groove 20 extending in the container axis O direction is formed in a portion located above the suction port 19 in the external thread 29.

An inner peripheral surface of the external upper cylindrical part 17*a* is defined as a cylindrical surface, and a portion (hereinafter referred to as an internal upper cylindrical part) 17*b*, which is constituted by the internal container 11, in the upper cylindrical part 17 is layered on the inner peripheral surface of the external upper cylindrical part 17*a* (see FIG. 17, etc.). An upper end portion of the internal upper cylindrical part 17*b* is folded radially outward and arranged at an opening end of the external upper cylindrical part 17*a*.

The discharge cap 15 includes an inside plug member 21 which closes the spout 13*a* of the container body 13 and a cylindrical body member 23 formed in a top-closed cylindrical shape, the cylindrical body member 23 covering the inside plug member 21 and being provided with the discharge port 14 (see FIG. 17, etc.). The inside plug member 21 includes: a plug body 47 having the outer circumferential end thereof arranged at the opening end of the spout 13*a* of the container body 13; and a cylindrical communicating part 22 which is formed upright from the plug body 47.

The plug body 47 includes: a bottom-closed internal cylindrical part 24 which is arranged in the spout 13*a* of the container body 13 with a gap between the internal cylindrical part 24 and the spout 13*a*; a flange 25 which is formed so as to protrude radially outward from an upper end of the internal cylindrical part 24 and arranged at the opening end of the spout 13*a* of the container body 13; an external cylindrical part 26 extending upward from an outer circumferential edge of the flange 25; and a middle cylindrical part 27 extending downward from the flange 25 so as to surround the internal cylindrical part 24 from the radially outer side, the middle cylindrical part 27 being fitted into the spout 13*a* of the container body 13 in a liquid-tight manner (see FIG. 17, etc.). Such internal cylindrical part 24, flange 25, external cylindrical part 26 and middle cylindrical part 27 are arranged coaxially with the container axis O. An external-air passage port 28 is formed at a lower end of the external cylindrical part 26, the external-air passage port 28 extending therethrough in the radial direction and opening downward.

The above-mentioned cylindrical communicating part 22 is arranged on a bottom wall of the internal cylindrical part 24. In addition, a through hole 42 is formed thorough the bottom wall, the through hole 42 opening into both the internal container 11 and the cylindrical communicating part 22. The through hole 42 is, for example, constituted by a plurality of small holes evenly arranged about the container axis O (see FIG. 17).

The cylindrical body member 23 is arranged coaxially with the container axis O and formed in a top-closed cylindrical shape. An inner peripheral surface of a peripheral wall 23*a* of the cylindrical body member 23 is provided with an internal thread 30 which is screwed with the external thread 29 on the spout 13*a* of the container body 13. A lower cylindrical part 18 in the spout 13*a* of the container body 13 is fitted in an airtight manner into a lower end portion located below a threaded portion, in which the internal thread 30 is formed, in the peripheral wall 23*a*, and the external cylindrical part 26 of the inside plug member 21 is fitted into an upper end portion located above the threaded portion.

Figure 20:
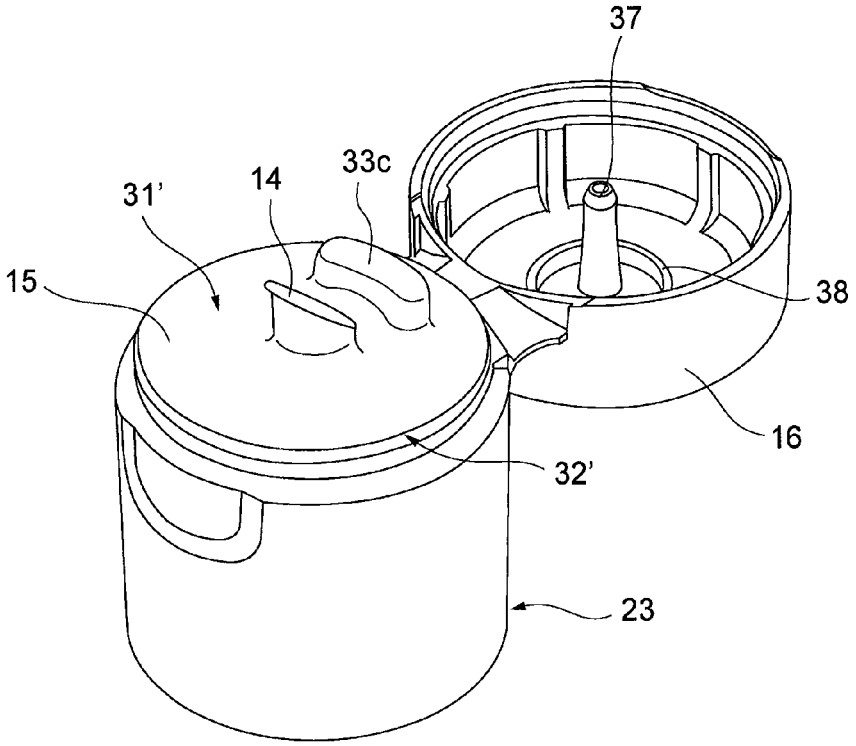
FIG. 20 is a perspective view showing the discharge cap with the over-cap opened.
Figure 21:
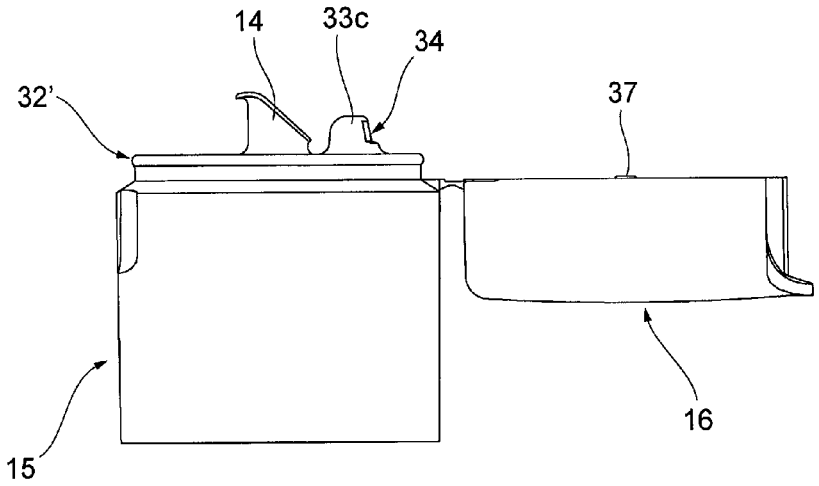
FIG. 21 is a side view showing the discharge cap with the over-cap opened.

A discharge port 14 for discharging the content M is formed in a top part 31' of the discharge cap 15 (see FIG. 20, etc.). Although the discharge port 14 is formed so as to be coaxial with the container axis O (see FIG. 17, etc.) in the dispensing container 10 of this embodiment, the discharge port 14 may be formed at a position shifted from the container axis O.

In addition, an external-air inlet protrusion 33*c* protruding upward is further formed in the top part 31' of the discharge cap 15 and an external-air inlet port 34 is formed in the external-air inlet protrusion 33*c* (see FIG. 17, etc.). In order to prevent the content M from being sucked from the external-air inlet port 34, the external-air inlet protrusion 33*c* is formed at a position higher than the discharge port 14 in the discharge posture where the dispensing container 10 is tilted so as to discharge the content M from the discharge port 14 (see FIG. 17, etc.).

Figure 24:
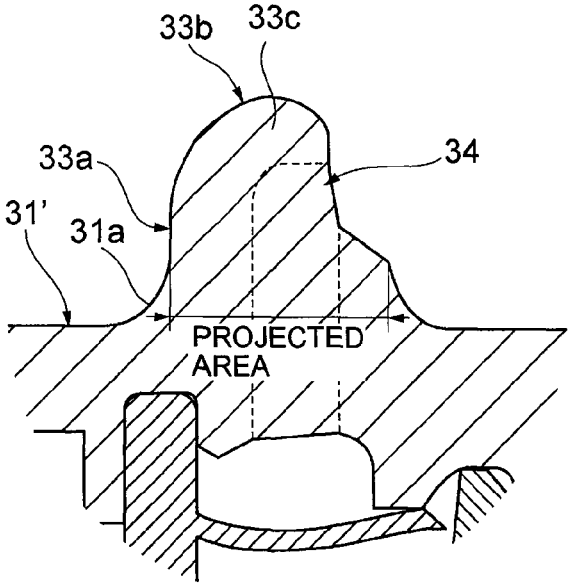
FIG. 24 is a view showing the portion shown in FIG. 23 in an enlarged manner.

In this embodiment, for example, the external-air inlet protrusion 33*c* includes: a cylindrical body 33*a* which is formed upright from the top part 31' (upper surface) between the discharge port 14 and the hinge 16*a*; and a dome-like top wall 33*b* which covers an upper end of the cylindrical body 33*a* (see FIG. 24).

By forming the top wall 33*b* in a dome-like shape (a curved surface), the liquid content adhering to the discharge cap 15 can be wiped off smoothly.

In addition, the external-air inlet port 34 is arranged at a position higher than the top part 31' with a spatial distance from the top part 31'. Thus, even if the content M which has dripped from the discharge port 14 adheres to an outer surface of the discharge cap 15, the dripped content M will hardly be sucked from the external-air inlet port 34. In addition, the external-air inlet port 34 is formed so as to be opened upward, more preferably opened vertically upward with respect to the external-air inlet protrusion 33*c* when the dispensing container 10 is tilted in the discharge posture in order to discharge the content from the discharge port 14 (see FIG. 17 etc.).

Figure 22:
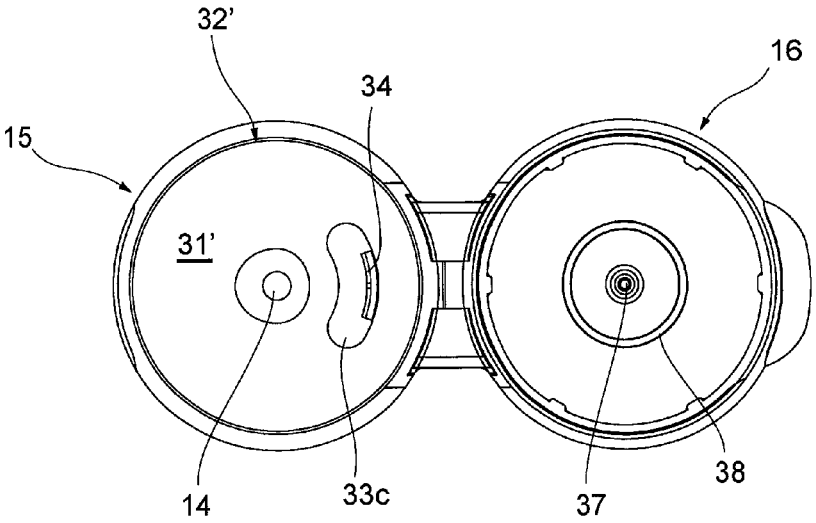
FIG. 22 is a plan view showing the discharge cap with the over-cap opened.

In addition, the projected area of the external-air inlet protrusion 33*c* in the plan view in this embodiment (see FIG. 22) is set to less than 7.0% with respect to the projected area of the top part 31', and the height of the external-air inlet protrusion 33*c* protruded from the top part 31' (a smooth upper surface) is set within the range of 3.0-3.5 mm.

By forming the external-air inlet protrusion 33 so as to occupy a small area and protrude by a small height, it becomes easy to wipe off the liquid content which has dripped and adhered to the discharge cap 15.

It should be noted that the projected area of the external-air inlet protrusion 33*c* is set to an area defined by an intersection between the extended line of a peripheral wall of the cylindrical body 33*a* and the top part 31' (a smooth upper surface).

A connecting part 31*a* formed by a smoothly curved surface as in this embodiment (see FIG. 24) may be provided between the peripheral wall of the cylindrical body 33*a* and the top part 31'.

The specific shape of the above external-air inlet protrusion 33*c* is not particularly limited. However, in the above embodiment, for example, the external-air inlet protrusion 33*c* is formed in a curved shape along a circular arc extending about the discharge port 14, the curved shape having a circumferential length larger than a thickness in the radial direction of the discharge cap 15 (the direction orthogonal to the container axis O direction) (see FIG. 20). The external-air inlet protrusion 33*c* having such shape can block the content M which has, for example, dripped and adhered to the outer surface of the discharge cap 15 from approaching the external-air inlet port 34 and thereby prevent the content M from being sucked into the external-air inlet port 34. Such external-air inlet protrusion 33*c* is also preferably curved along a circular arc extending about the discharge port 14.

The discharge cap 15 is provided with an engagement part 32' with which the over-cap 16 is to be engaged in the covered state. In this embodiment, for example, a step which is slightly overhanging in the radial direction is formed around an upper edge of the discharge cap 15 and this step constitutes the engagement part 32' with which the over-cap 16 is to be engaged in the covered state (see FIGS. 17, 20, etc.).

The top part 31' is formed from: an upper surface (a smooth upper surface) which is a horizontal smooth surface having a circular shape in the plan view; and an upper surface of the engagement part 32' formed so as to be smoothly continuous from the smooth upper surface (an area extending from the connected portion to the outermost edge (defining the largest outer diameter)). The upper surface of the engagement part 32' is formed, for example, by a curved line which bulges outward in the vertical cross section. In the dispensing container 10 of this embodiment, for example, in the entire upper surface of the top part 31', an area excluding a portion where the discharge port 14 is formed and a portion where the external-air inlet projection 33*c* is formed as a horizontal smooth surface. In this case, even if the content M adheres to the top part 31' of the discharge cap 15 due to dripping or the like, it can be wiped off easily even by a quick wiping motion.

The top part 31' is provided with a cylindrical receiver 35 which extends downward and whose outer diameter is approximately the same as the internal diameter of the externally-fitted cylindrical part 40 (to be described later). In addition, a discharge pipe 36, the interior of which defines the discharge port 14, extends through the top part 31'.

The discharge pipe 36 has an upper opening end which is tilted diagonally upward from the rear-end side thereof (the side of the external-air inlet protrusion 33*c*) toward the opposite side, i.e., the front-end side thereof, so that the rear end of the discharge pipe 36 is lower than the external-air inlet protrusion 33*c* and the front end of the discharge pipe 36 is higher than the external-air inlet protrusion 33*c*.

This configuration can secure a large opening area for the upper opening end. Thus, even if the liquid content splashes from the rear end of the discharge pipe 36, the liquid content can still be prevented from flowing into the external-air inlet port 34.

Figure 23:
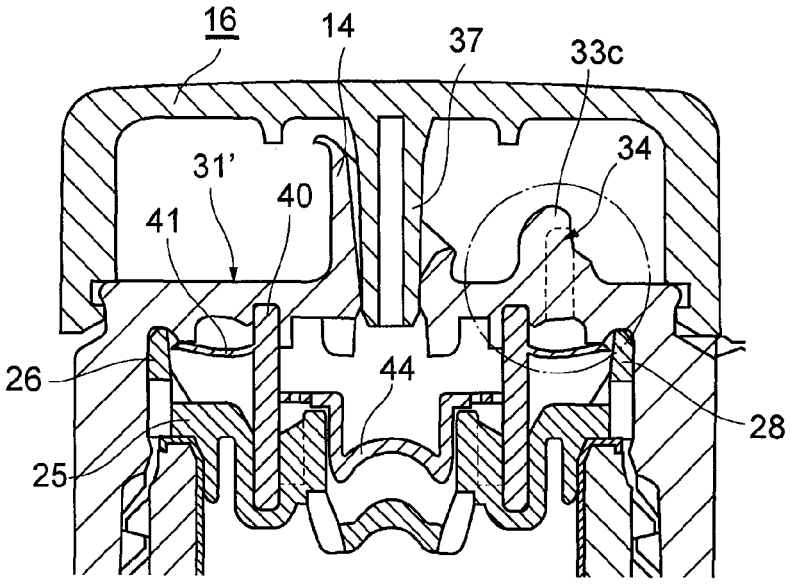
FIG. 23 is a vertical cross-sectional view showing a portion of the discharge cap being covered with the over-cap.

An inner cylindrical seal part (seal part) 37 extending downward from the over-cap 16 is fitted into the discharge pipe 36 (see FIGS. 16, 20, 23, etc.). In addition, an outer cylindrical seal part (annular projection) 38 is formed around the inner cylindrical seal part 37 so as to protrude downward from the back surface of the over-cap 16 (see FIG. 20, etc.)

The externally-fitted cylindrical part 40 which is externally fitted onto the cylindrical communicating part 22 of the inside plug member 21 is arranged between the inside plug member 21 and the cylindrical body member 23. The externally-fitted cylindrical part 40 is arranged coaxially with the container axis O. A lower end portion of the externally-fitted cylindrical part 40 is externally fitted onto the cylindrical communicating part 22 and also fitted into the internal cylindrical part 24 of the inside plug member 21. An upper end portion of the externally-fitted cylindrical part 40 is externally fitted onto the cylindrical receiver 35 of the cylindrical body member 23.

Figure 18:
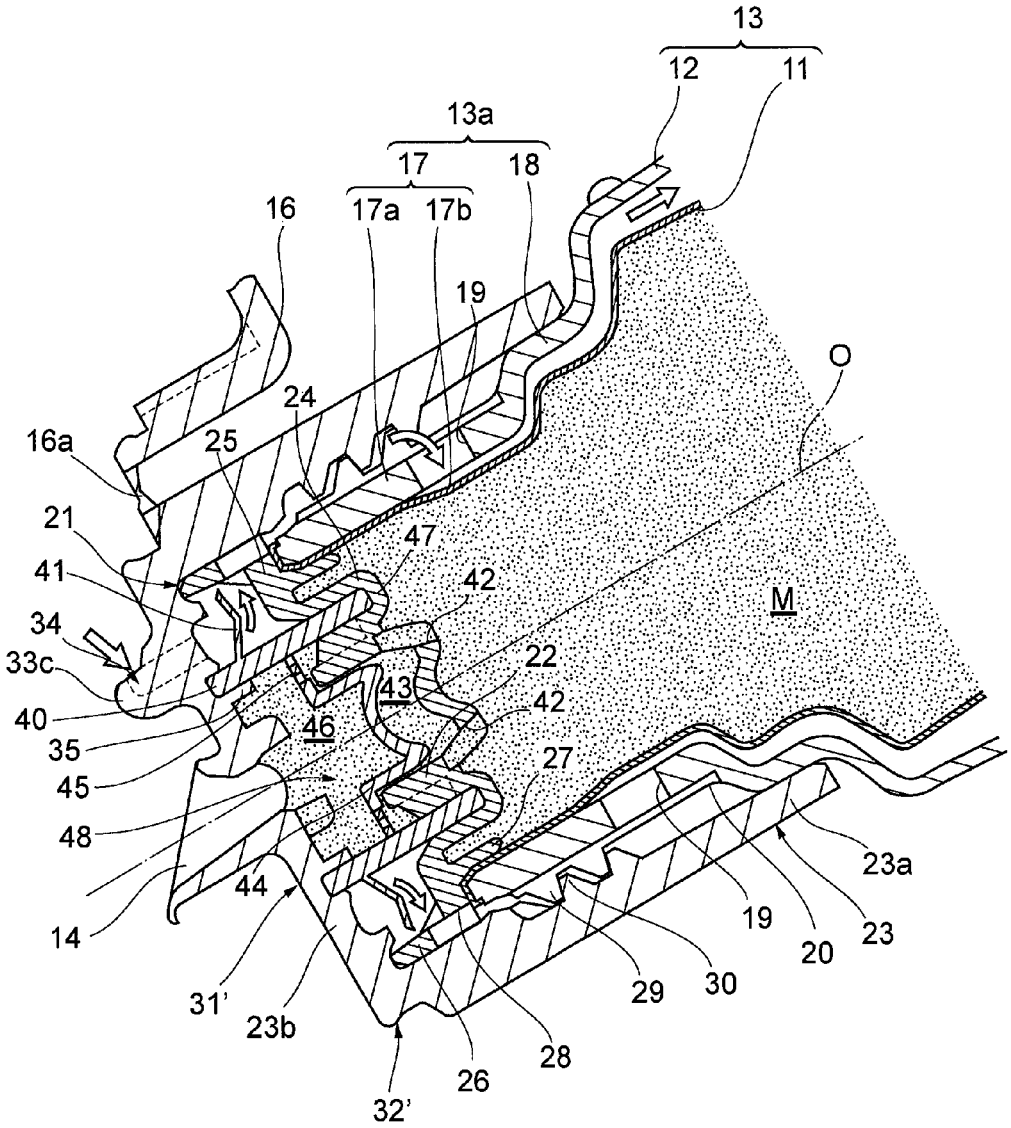
FIG. 18 is a vertical cross-sectional view explaining how the dispensing container acts during restoration after the discharge of the content.
Figure 19:
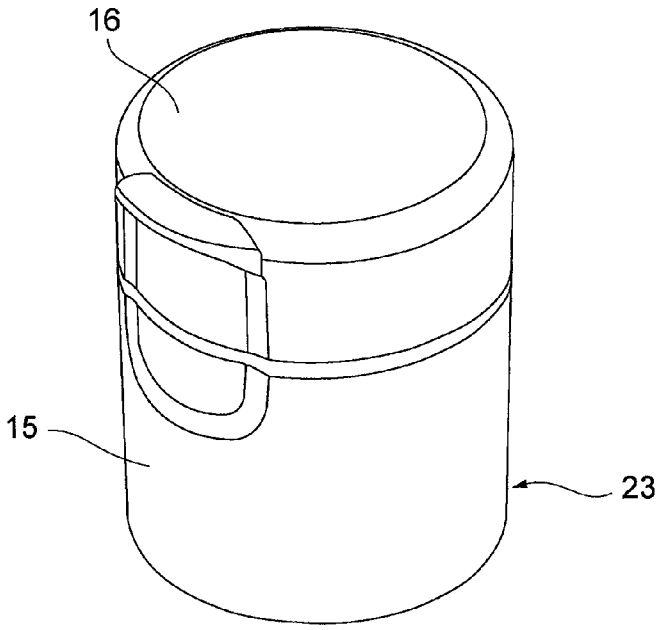
FIG. 19 is a perspective view showing a discharge cap being covered with an over-cap.

An annular air valve 41 is provided so as to protrude radially outward in the middle, in the container axis O direction, of the externally-fitted cylindrical part 40 (see FIGS. 17, 18, etc.). The air valve 41 is elastically deformable and switches between the communicated state and shutoff state of the communication between the suction port 19 and the external-air inlet port 34.

The inside plug member 21 is provided with a communication port 43 (a communication recess) which communicates the discharge pipe 36 and the inside of the internal container 11. The communication port 43 is defined by the interior of the cylindrical communicating part 22 and arranged coaxially with the container axis O. With such configuration, the container axis O direction and the axial direction of the communication port 43 coincide with each other. In the illustrated example, the communication port 43 is located below the discharge pipe 36, i.e., on the inner side of the internal container 11 along the container axis O direction. In addition, the internal volume of the communication port 43 is larger than the internal volume of the discharge pipe 36.

A valve body 44 is arranged and fitted into the cylindrical communicating part 22 of the inside plug member 21 so as to be slidable along the container axis O direction and the valve body 44 slides along the container axis O direction so as to open and close the communication port 43. The valve body 44 is formed in a bottom-closed cylindrical shape arranged coaxially with the container axis O and has an annular flange which protrudes radially outward from an end on the upper side (upper end) in the container axis O direction. An annular upper end surface of the cylindrical communicating part 22 functions as a valve seat (valve holder) which abuts onto the flange of the valve body 44. In this configuration, an outer peripheral surface of the valve body 44 and an inner peripheral surface of the communication port 43 may be close to each other but not in contact with each other, with a gap therebetween, or the bottom surface of the valve body 44 may be formed so as not to abut onto a portion located on the radially inner side with respect to the cylindrical communicating part 22 in the plug body 47.

An upper end of the valve body 44 is abutted onto the upper end surface of the cylindrical communicating part 22 or located above the upper end surface of the cylindrical communicating part 22 and, as shown in FIGS. 17 and 18, the upper end of the valve body 44 is connected to one end of each of a plurality of elastic connecting pieces 45 which connect the valve body 44 and the externally-fitted cylindrical part 40 to each other. The plurality of elastic connecting pieces 45 (in the illustrated example, three elastic connecting pieces 45) are arranged circumferentially with gaps therebetween, each of which is circumferentially curved. The positions of both ends of each elastic connecting piece 45 approximately coincide with each other in the container axis O direction. It should be noted that the valve body 44, the externally-fitted cylindrical part 40, the elastic connecting pieces 45 and the air valve 41 are integrally formed to constitute a connector 48.

Next, the effects of the dispensing container 10 having the above configurations will be described below.

As shown in FIG. 17, when the content M is discharged from the dispensing container 10, the over-cap 16 is first removed from the discharge cap 15. Then, in a state in which the dispensing container 10 is tilted in a discharge posture so that the discharge port 14 is directed downward with respect to the horizontal plane, the dispensing container 10 is pressed radially inward so as to be squeezed and deformed (elastically deformed), and the internal container 11 is deformed together with the external container 12 so as to reduce the volume thereof.

As a result, the pressure inside the internal container 11 increases so as to cause the content M in the internal container 11 to press the valve body 44 via the through hole 42, the connecting pieces 45 are elastically deformed so as to cause the valve body 44 to be slid along the container axis O direction toward the outside of the internal container 11, and the communication port 43 is opened. Consequently, the content M in the internal container 11 is discharged via the through hole 42, the communication port 43, the inside of the externally-fitted cylindrical part 40 and the discharge port 14 to the outside (see FIG. 17).

Then, by stopping or releasing the pressing against the dispensing container 10 so as to weaken the pressing force of the content M in the internal container 11 against the valve body 44, a pressure difference generated by the elastic restoring force of the dispensing container 10 causes the valve body 44 to be slid along the container axis O direction toward the inner side of the internal container 11 (see FIG. 18).

At this time, when the valve body 44 enters the communication port 43 as shown in FIG. 18, the outer peripheral surface of the valve body 44 is brought into contact with and slid along the inner peripheral surface of the communication port 43 and the gap between the communication port 43 and the valve body 44 is thus closed. As a result, an internal space 46, in which the content M which has not been returned to the internal container 11 remains, is formed between the cylindrical body member 23 and the inside plug member 21. The internal space 46 communicates with the discharge port 14 and has the valve body 44 as a part of its delimiting walls. The valve body 44 shuts off the communication between the internal space 46 and the communication port 43.

When, after the internal space 46 is formed as described above, the valve body 44 continues to slide along the container axis O direction in the communication port 43, the internal volume of the internal space 46 increases with the sliding of the valve body 44. Accordingly, it becomes possible to introduce the content M in the discharge port 14 into the internal space 46 and to suck the external air into the discharge port 14.

When the pressing against the container body 13 is released in the state where the communication port 43 is being shut off by the valve body 44, the external container 12 is restored to the original shape while the internal container 11 remains deformed with the reduced volume. At this time, negative pressure is generated between the internal container 11 and the external container 12, and the negative pressure acts on the air valve 41 via the suction port 19 and causes the air valve 41 to be opened. Then, the external air is introduced in between the external container 12 and the internal container 11 via the external air-inlet port 34, the external-air passage port 28, the communication groove 20 and the suction port 19 (see FIG. 18). When the internal pressure between the external container 12 and the internal container 11 increases so as to match the atmospheric pressure, the air valve 41 is restored to its original shape and shuts off the suction port 19 from the outside. As a result, the reduced-volume shape of the internal container 11 is retained after the discharge of the content M.

From this state, when the external container 12 of the container body 13 is squeezed and deformed again, the internal pressure between the external container 12 and the internal container 11 becomes positive due to the shutoff state of the air valve 41, and this positive pressure causes the internal container 11 to be deformed so as to reduce the volume thereof and the content M is discharged due to the aforementioned effect.

If, after the content M is discharged and before the communication port 43 is shut off by the valve body 44, the pressing against the dispensing container 10 is not only stopped but also released, the internal container 11 will be restored to the original shape by following the behavior of the external container 12. Then, the pressure inside the internal container 11 will decrease to a negative pressure and this negative pressure will act on the valve body 44, so that the valve body 44 is smoothly slid along the container axis O direction toward the inner side of the internal container 11.

As described above, since the dispensing container 10 according to this embodiment allows, after the discharge of the content M, the content M in the discharge port 14 to be introduced into the internal space 46 and allows the external air to be sucked into the discharge port 14, it becomes possible to prevent the content M, which has not been returned to the internal container 11, from remaining inside the discharge port 14. It is therefore possible to prevent the content M from leaking out of the discharge port 14 after the discharge of the content M.

In addition, even if the valve body 44 is unintentionally displaced toward the inner side of the internal container 11 along the axial direction, the flange of the valve body 44 will still abut onto the annular upper end surface of the cylindrical communicating part 22 of the plug body 47 and such unintentional displacement of the valve body 44 will still able to be restricted.

If the bottom surface of the valve body 44 abuts onto the plug body 47 when the dispensing container 10 is not being operated as in this embodiment, the communication between the communication port 43 and the through hole 42 can be shut off by the valve body 44. In this case, when the valve body 44 is displaced so as to be restored after the content M is discharged and the internal space 46 is formed as described above, the valve body 44 can be slid in the communication port 43 over its entire length along the container axis O direction. This can ensure that the internal volume of the internal space 46 increases and the aforementioned effects and advantages can be significantly exerted.

Since the inner cylindrical seal part 37 is provided in the over-cap 16, the content M can be prevented from being unintentionally leaked out of the discharge port 14 with the over-cap 16 being closed. After the discharge of the content M, the content M which has not been returned to the internal container 11, hardly remains in the discharge port 14, as described above. Thus, when the over-cap 16 is attached onto the discharge cap 15 after the discharge of the content M and the inner cylindrical seal part 37 is fitted into the discharge port 14, the content M can be prevented from being pressed out of the discharge port 14 by the inner cylindrical seal part 37 and the content M can be prevented from adhering to the inner cylindrical seal part 37.

In typical related-art delamination containers, an internal container is formed of a flexible material which deforms so as to reduce the volume thereof with the decreasing amount of the liquid content, while an external container is formed of an elastically deformable material, and the external air in an amount according to the amount of the content M which has been discharged is sucked from an external-air inlet port and introduced in between the internal container and the external container (see, for example, Japanese Patent Nos. 4024396 and 3688373).

In terms of the dispensing containers represented by the above delamination containers, a container has been known in which an external-air inlet port for introducing external air into the container is formed on the lid thereof (a discharge cap) (see, for example, Japanese laid-open publication Nos. H07-000860 and 2011-084283).

However, in the related-art dispensing containers such as those disclosed in Japanese laid-open publication Nos. H07-000860 and 2011-084283, the liquid content which has adhered to the discharge cap due to dripping or the like may be sucked into the external-air inlet port. In addition, in such related-art dispensing containers, the liquid content which has adhered to the discharge cap due to dripping or the like may not be wiped off easily.

In order to solve these problems, the inventors have conducted various studies. In some of the related-art dispensing containers described above, a step is formed in a discharge cap of the container and an upper surface or a rear portion in a peripheral surface of such step is used for forming an opening for introducing external air (see, for example Japanese Patent No. 3688373, FIGS. 2 and 7 as well as Japanese laid-open publication No. 2011-084283, FIG. 5). In such containers, the liquid content, which has dripped and adhered to the discharge cap, might be sucked from the external-air inlet port and such liquid content enters the space between the internal container and the external container where only the external air (air) should be allowed to enter, in the delamination container. In particular, in a container which employs a transparent or translucent film as a material of the external container and the internal container in order to make the liquid content visible, the liquid content, which has entered the space between the internal container and the external container where only the air should be allowed to enter, becomes inevitably visible, and such situation may cause the users thereof to have doubts about the structure of the container, may degrade the appearance of the container and may degrade the usability of the container.

In addition, after studying the situations where the liquid content which has dripped and adhered to the discharge cap is wiped off, the inventors have found that the liquid content which has adhered on a discharge cap whose top surface has been formed as a flat surface can be wiped off relatively easily, e.g., wiped off by one quick wiping motion. However, in practice, the discharge cap is often provided with a step as described above. In such discharge cap, the liquid content which has not been successfully wiped off by a quick wiping motion would remain in a recess of the step, resulting in a degraded appearance and degraded usability which are unpleasant for the users.

The inventors conducted further studies on the structures of the related-art containers and the phenomena caused by those structures and achieved findings which can solve the problems above. The present invention has been made based on such findings and provides a dispensing container comprising: a container body having a flexible internal container which contains content and deforms so as to deflate with a decreasing amount of the content and an elastically deformable external container in which the internal container is attached, the external container being provided with a suction port for sucking the external air in between the external container and the internal container; a discharge cap which includes a top part having a horizontal smooth upper surface on which a discharge pipe for discharging the content and a top-closed cylindrical external-air inlet protrusion are independently formed upright, the discharge cap being attached to a spout of the container body; an external-air inlet port formed in the external-air inlet protrusion so as to be apart from the top part, the external-air inlet port communicating between a suction port and the outside; an air valve which switches between a communicated state and a shutoff state of the communication between the external-air inlet port and the suction port; and an over-cap which is removably attached to the discharge cap, wherein the discharge pipe includes an upper opening edge which is tilted diagonally upward from the rear-end of the external-air inlet protrusion toward the opposite, front end thereof, and in which the external-air inlet protrusion has a cylindrical body provided upright on the top part and with a dome-like top wall which covers the upper end of the cylindrical body, the external-air inlet protrusion being formed so as to have a height protruding from the top part within a range of 3.0 mm to 3.5 mm and so as to be lower than the front end of the discharge pipe and higher than the rear end of the discharge pipe, the projected area of the external-air inlet protrusion in plan view being set to less than 7.0% of the top part.

Since the external-air inlet port in the dispensing container is formed in the external-air inlet protrusion which is protruded upright from the top part, it is located above the top part with a spatial distance from the top part. Thus, even if the content dripped from the discharge port adheres to the discharge cap, the dripped content can still be prevented from being sucked into the external-air inlet port.

In addition, in the dispensing container according to the present invention, a relatively large area in the top part of the discharge cap can be secured for the opening area of the discharge pipe for discharging the content. Thus, it is possible to form a wide discharge port, being constituted by the discharge pipe, for discharging the content and is therefore possible to construct a container capable of easily discharging the content.

According to the present invention, even if the content splashes from the discharge pipe when the dispensing container, after discharging the content, is restored to the vertical posture, a lateral wall of the external-air inlet protrusion (a lateral surface where the external-air inlet port is not formed) blocks the splashed content and prevents it from entering the container from the external-air inlet port.

In addition, in the dispensing container according to the present invention, since the upper surface of the external-air inlet protrusion is formed as a curved (dome-like) surface and the area occupied by the external-air inlet protrusion in the top part can be set so as to be relatively small, the content which has adhered to the discharge cap can be wiped off relatively smoothly with few obstacles.

In the dispensing container according to the present invention, the external-air inlet protrusion may be formed at a position which becomes higher than the discharge pipe and the external-air inlet port may be formed so as to open vertically upward when the dispensing container is being tilted in a discharge posture in order to discharge the content from the discharge pipe.

The external-air inlet protrusion may be curved in a circular arc along the circumferential direction in the top part.

According to the present invention described above, it is possible to prevent the liquid content which has dripped and adhered to the discharge cap from being sucked into the external-air inlet port. In addition, according to the present invention described above, the liquid content which has dripped and adhered to the discharge cap can be wiped off easily.

It should be noted that the technical scope of the present invention is not limited to the embodiments above and various modifications may be added without departing from the gist of the present invention.

INDUSTRIAL APPLICABILITY

The present invention is suitably applied to dispensing containers having a delamination structure.

DESCRIPTION OF REFERENCE NUMERALS

M: content
O: container axis (axis)
10, 50, 70: dispensing container
11: internal container
12: external container
13: container body
13*a*: spout
14: discharge port
15: discharge cap
16: over-cap
19: suction port
21: inside plug
22: cylindrical communicating part
22*a*: valve seat
22*b*: flow-allowing member
23: cylindrical body member
23*c*: displacement amount restrictor
31': top part
32': engagement part (portion engaged with the over-cap 16)
33: external-air inlet projection
34: external-air inlet port
36: discharge pipe
37: inner cylindrical seal part (seal part)
41: air valve
42: through hole
43: communication port
44: valve body
45: elastic connecting piece
47: plug body

What is claimed is:

1. A dispensing container comprising:

a container body having a flexible internal container to contain content and deforms so as to deflate with a decreasing amount of the content and an external container in which the internal container is attached, the external container being provided with a suction port for sucking external air in between the internal container and the external container;

a discharge cap which is attached to a spout of the container body and provided with a discharge port for discharging the content;

an external-air inlet port which communicates between outside and the suction port; and an air valve which switches between a communicated state and a shutoff state of communication between the external-air inlet port and the suction port, wherein:

the discharge cap includes: an inside plug member which closes the spout;

and a cylindrical body member having a top-closed cylindrical shape, the cylindrical body member covering the inside plug member and being provided with the discharge port;

the inside plug member is provided with a communication port which communicates between the discharge port and the internal container; and a valve body is arranged and fitted in the communication port so as to be slidable along an axial direction of the communication port, the valve body being elastically displaced along the axial direction so as to open and close the communication port.

2. The dispensing container according to claim 1, wherein the inside plug member includes:

a plug body having an outer circumferential end arranged on an opening end of the spout, the plug body having a through hole which extends therethrough and opens to an interior of the internal container; and a cylindrical communicating part which is provided upright on the plug body and in which the through hole opens, and where an interior of the cylindrical communicating part defines the communication port, wherein the through hole has a diameter smaller than that of the communication port.

3. The dispensing container according to claim 2, wherein the valve body is connected via a plurality of deformable elastic connecting pieces to a cylindrical member which is arranged coaxially with the cylindrical communicating part.

4. The dispensing container according to claim 3, wherein the plurality of elastic connecting pieces are arranged circumferentially at regular intervals about the axial direction of the communication port.

5. The dispensing container according to claim 4, wherein the plurality of elastic connecting pieces are each circumferentially curved.

6. The dispensing container according to claim 1, wherein the cylindrical body member is provided with a displacement amount restrictor which abuts onto the valve body slidable along the axial direction to restrict an amount of elastic displacement of the valve body.

7. The dispensing container according to claim 1, further comprising:

an over-cap removably attached to the discharge cap, wherein the over-cap is provided with a seal part which is removably fitted into the discharge port.

8. The dispensing container according to claim 7, wherein the seal part suppresses the elastic displacement of the valve body in a covered state with the over-cap being closed.

9. The dispensing container according to claim 1, wherein a flow-allowing groove which allows the content to flow therethrough is formed in a portion of a valve seat of the valve body, the portion being in contact with the valve body.

* * * * *